US009278540B2

(12) United States Patent
Seki et al.

(10) Patent No.: US 9,278,540 B2
(45) Date of Patent: Mar. 8, 2016

(54) LIQUID STORAGE CONTAINER AND LIQUID EJECTION APPARATUS

(71) Applicant: CANON KABUSHIKI KAISHA, Tokyo (JP)

(72) Inventors: Masafumi Seki, Kawasaki (JP); Naozumi Nabeshima, Tokyo (JP); Koichi Kubo, Yokohama (JP); Kazuya Yoshii, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/744,973

(22) Filed: Jun. 19, 2015

(65) Prior Publication Data

US 2015/0375515 A1 Dec. 31, 2015

(30) Foreign Application Priority Data

Jun. 27, 2014 (JP) ..... 2014-132860

(51) Int. Cl.
*B41J 2/175* (2006.01)

(52) U.S. Cl.
CPC ..... *B41J 2/17523* (2013.01)

(58) Field of Classification Search
USPC ..... 347/84–86, 6, 7
See application file for complete search history.

(56) References Cited

U.S. PATENT DOCUMENTS

| | | | | |
|---|---|---|---|---|
| 7,703,867 | B2 * | 4/2010 | Katsumura | 347/7 |
| 7,950,790 | B2 | 5/2011 | Kubo et al. | 347/86 |
| 8,047,641 | B2 | 11/2011 | Nanjo et al. | 347/86 |
| 8,205,974 | B2 | 6/2012 | Ogura et al. | 347/86 |
| 8,469,498 | B2 | 6/2013 | Ohashi et al. | 347/86 |
| 8,770,730 | B2 | 7/2014 | Nanjo et al. | 347/86 |
| 2002/0145650 | A1 * | 10/2002 | Pan et al. | 347/85 |
| 2005/0264624 | A1 * | 12/2005 | Ogura et al. | 347/86 |
| 2010/0026742 | A1 * | 2/2010 | Morino | 347/7 |
| 2011/0234719 | A1 | 9/2011 | Mizutani et al. | 347/86 |

FOREIGN PATENT DOCUMENTS

JP 2011-206936 10/2011

OTHER PUBLICATIONS

U.S. Appl. No. 14/744,939, filed Jun. 19, 2015.
U.S. Appl. No. 14/744,926, filed Jun. 19, 2015.
U.S. Appl. No. 14/724,343, filed May 28, 2015; Inventors: Akira Shiba, Naozumi Nabeshima, Koichi Kubo.

* cited by examiner

*Primary Examiner* — Kristal Feggins
(74) *Attorney, Agent, or Firm* — Fitzpatrick, Cella, Harper & Scinto

(57) ABSTRACT

There is provided a liquid storage container capable of efficiently using a liquid stored therein. An ink cartridge has a flexible member having flexibility attached to a wall surface inside a housing to define a space inside the housing. In a position during use, an angle between the wall surface inside the housing and the flexible member in a lower attachment position of the flexible member to the housing is greater than an angle between the wall surface inside the housing and the flexible member in an upper attachment position.

13 Claims, 12 Drawing Sheets

LIQUID STORAGE CONTAINER AND LIQUID EJECTION APPARATUS

BACKGROUND OF THE INVENTION

1. Field of the Invention

The present invention relates to a liquid storage container and a liquid ejection apparatus capable of ejecting liquid from the liquid storage container.

2. Description of the Related Art

Some ink jet printing apparatus have a system in which an ink storage container is mounted on a carriage and ink stored in the ink storage container is supplied to a print head. In the ink jet printing apparatus having such a system, it is preferable that the ink stored in the ink storage chamber be used up as much as possible. Using up the ink in the ink storage chamber can reduce the amount of ink wasted and discarded so as to efficiently use the ink.

An example of a configuration for using up ink in an ink storage container as much as possible is disclosed, for example, in Japanese Patent Laid-Open No. 2011-206936. Japanese Patent Laid-Open No. 2011-206936 discloses an ink storage container in which ink is stored in a space partly formed by a flexible film, and a plate member and a spring are disposed in the space having ink stored therein. In the ink storage container disclosed in Japanese Patent Laid-Open No. 2011-206936, a ventilation film for causing air to flow into the space is disposed on an atmosphere opening hole which allows the inside of the space to communicate with the atmosphere if a negative pressure in the space increases as the ink in the space having the ink stored therein is consumed. Since air corresponding to an amount of ink consumed inside the space flows into the space, the ink and the air are replaced. By applying the ventilation film having such a configuration to the ink storage container, it is possible to efficiently use the ink stored inside the space and to use up the ink inside ink storage chamber as much as possible.

SUMMARY OF THE INVENTION

In a first aspect of the present invention, there is provided a liquid storage container comprising: a housing member having a space therein; a defining member attached to a wall surface inside the housing member to define the space and including a flexible member having flexibility; a liquid storage chamber provided in the space defined and capable of storing a liquid therein; and an urging unit configured to urge the defining member in a direction in which a volume of the liquid storage chamber expands, wherein in a position during use, an angle between the wall surface inside the housing member and the defining member in a lower attachment position of the defining member to the housing member is greater than an angle between the wall surface inside the housing member and the defining member in an upper attachment position of the defining member to the housing member.

Further features of the present invention will become apparent from the following description of exemplary embodiments (with reference to the attached drawings).

DESCRIPTION OF THE EMBODIMENTS

As disclosed in Japanese Patent Laid-Open No. 2011-206936, even with a system in which air corresponding to an amount of ink consumed flows into the ink storage container as the ink in the ink storage container is consumed, ink may remain in the ink storage container. Even if air flows into the ink storage container, ink may remain in the ink storage container depending on the shape or the like of a space in which ink is stored in the ink storage container.

In view of the above circumstances, an object of the present invention is to provide a liquid storage container capable of efficiently using a liquid stored therein.

A description will be given of an ink cartridge as a liquid storage container according to embodiments of the present invention. It should be noted that the following embodiments are examples of preferred embodiments for carrying out the present invention, and the present invention should not be limited to these configurations.

(Configuration of Ink Jet Printing Apparatus)

Figure 1:
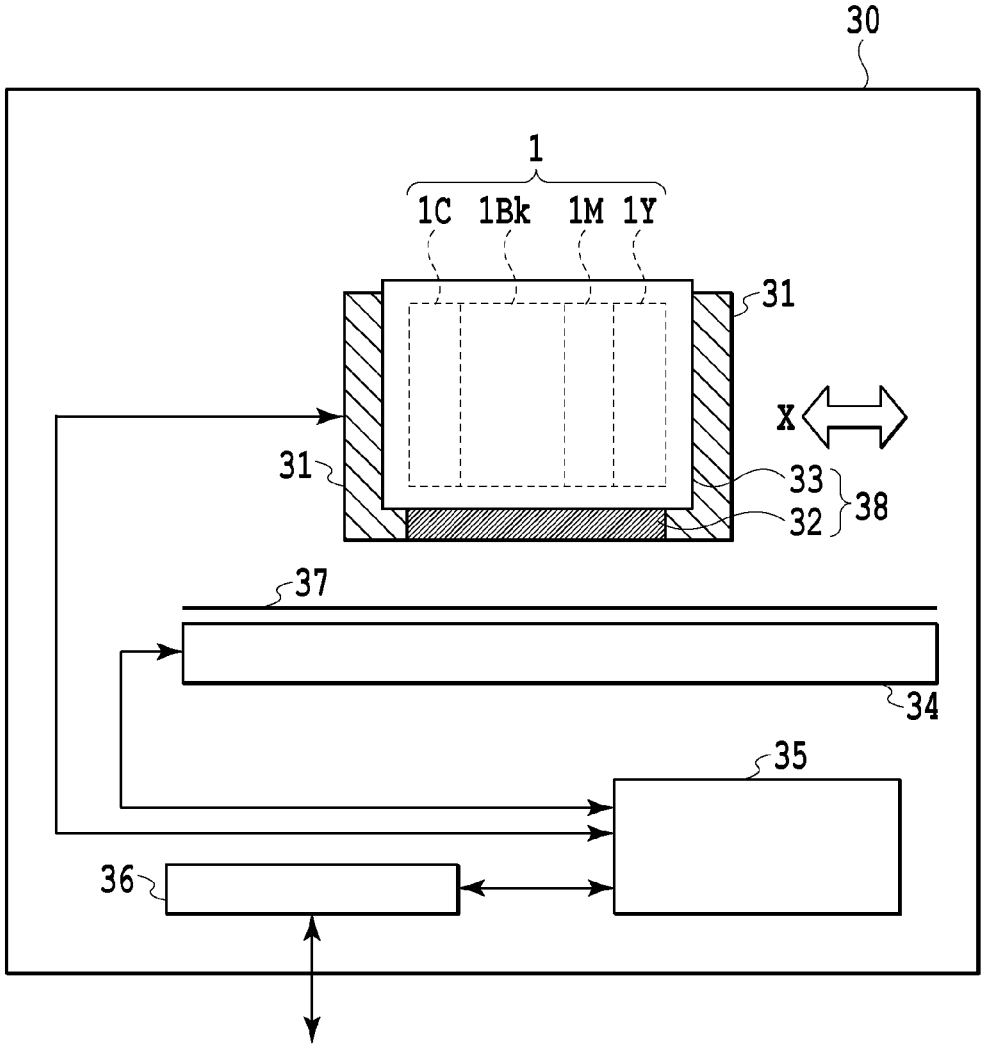
FIG. 1 is a cross-sectional view schematically showing a general configuration of an ink jet printing apparatus on which an ink cartridge is mounted according to a first embodiment of the present invention.

FIG. 1 shows a general configuration of an ink jet printing apparatus (liquid ejection apparatus) on which an ink cartridge is mounted according to the present embodiment. FIG. 1 shows that an ink cartridge 1 as a liquid storage container is mounted on a printing apparatus body (hereinafter also referred to as an "apparatus body") 30. The printing apparatus body 30 includes a carriage 31, on which a mounting portion 33 is mounted. A print head 32 is mounted on the mounting portion 33. Further, the printing apparatus body 30 has a conveying unit 34 for conveying a print medium. The printing apparatus body 30 also has a control unit 35 for controlling operations of each of the devices in the printing apparatus body 30 and an input/output unit 36 for receiving/sending signals from/to the control unit 35. The printing apparatus body 30 further has an outer cover that can be open or closed (not shown), a feeding unit for feeding a print medium, a feeding cassette, a discharge tray, an operation unit, and the like. The printing apparatus body 30 may be connected to external devices (not shown) such as a computer, a digital camera, a memory card, and the like via the input/output unit 36.

The control unit 35 controls the entire printing apparatus body 30, controls information communications with the ink cartridge 1, analyzes and processes information input from the external devices via the input/output unit 36, outputs information to the input/output unit 36, and the like. For example, the control unit 35 provides instructions for operating devices such as the carriage 31, the print head 32, the conveying unit 34, and the feeding unit and controls the operations of the devices. The control unit 35 can also perform control to read information unique to a cartridge such as an ink color, an initial amount of ink filled, and an ink consumption from a memory element provided for the ink cartridge 1 and control to write the information such as the ink consumption into the memory element provided for the ink cartridge 1. Furthermore, the control unit 35 can also analyze and process information such as printing instructions and image data inputted from the external devices via the input/output unit 36 and output information such as a remaining amount of ink to the input/output unit 36.

Figure 5:
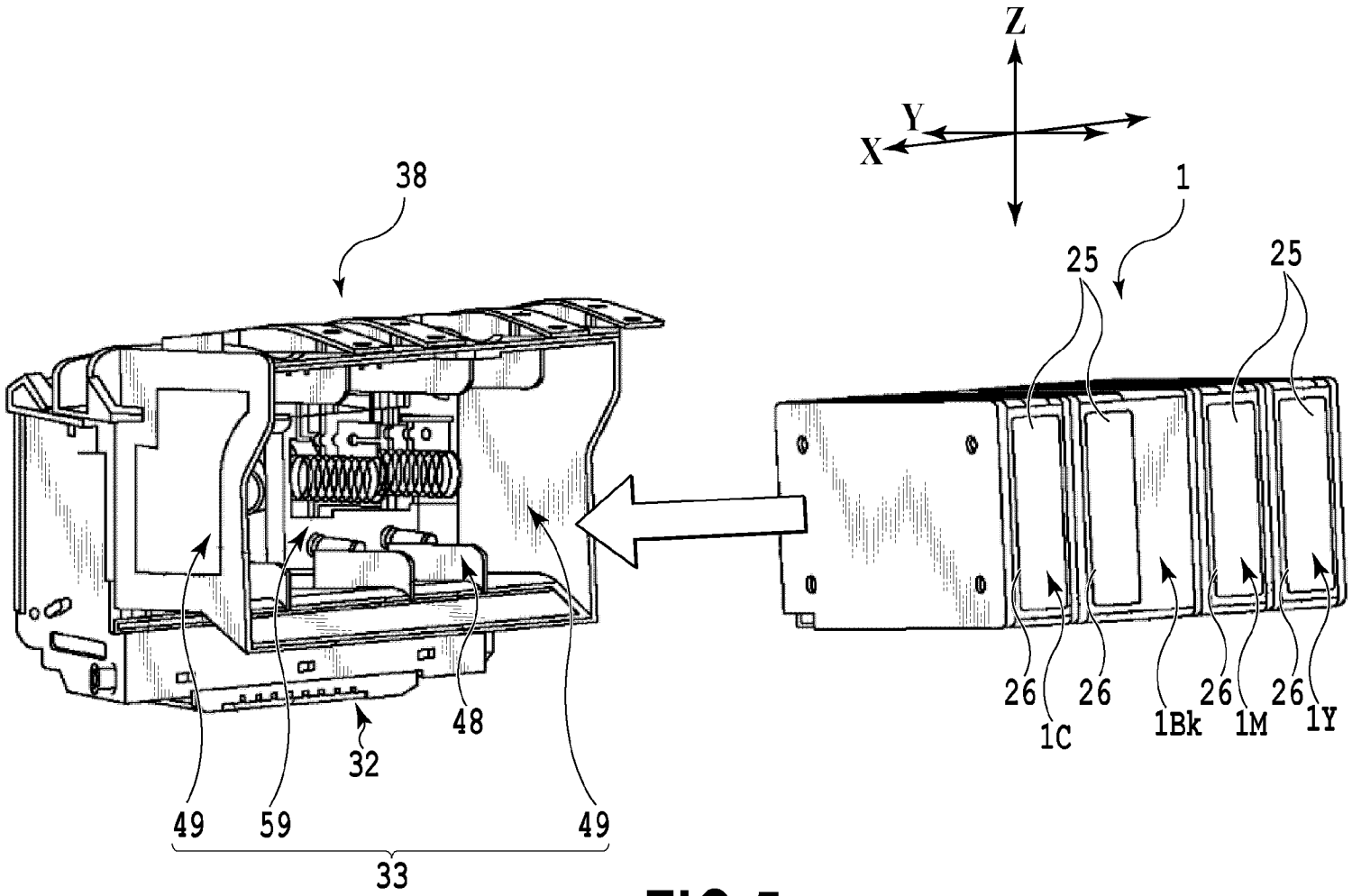
FIG. 5 is a perspective view of the ink cartridge of FIG. 2 and a head unit when the ink cartridge is mounted on the head unit.
Figure 6:
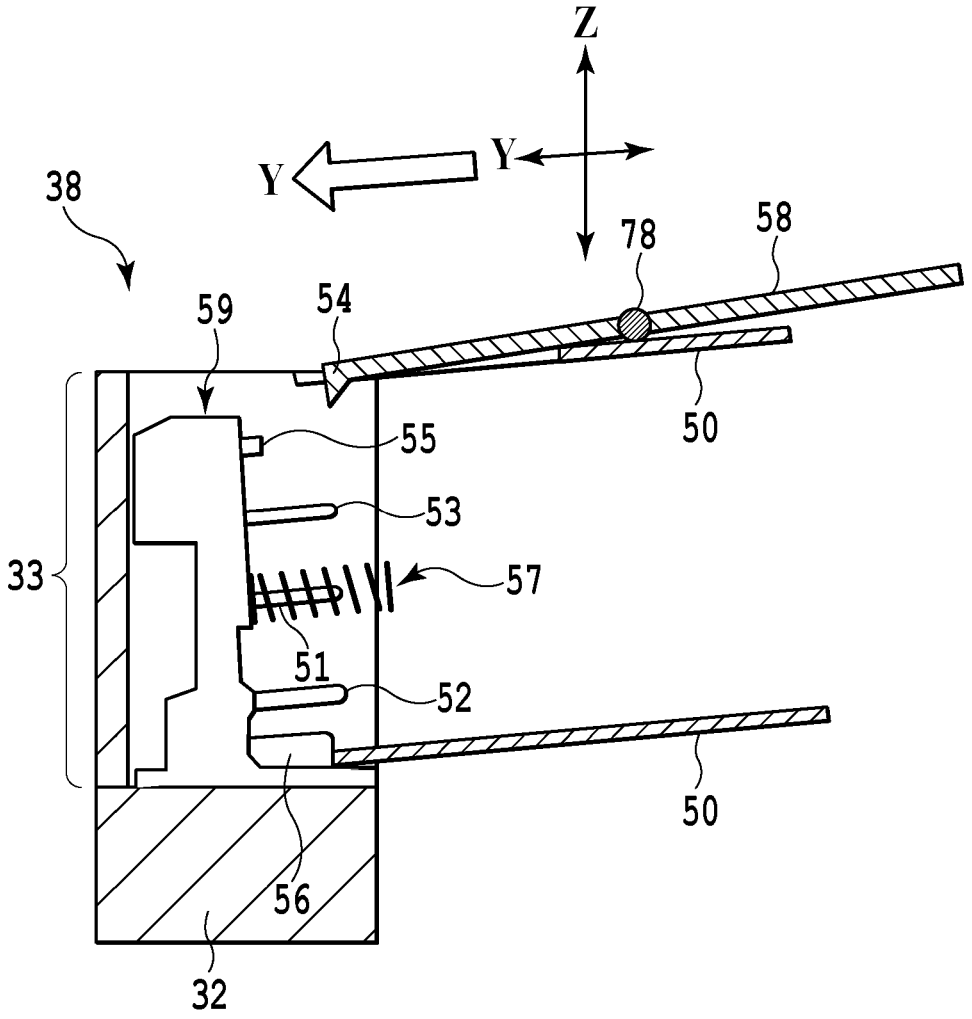
FIG. 6 is a cross-sectional view showing the head unit on which the ink cartridge of FIG. 2 is mounted as viewed from the side.

The carriage 31 is provided with a mounting portion (hereinafter also referred to as a "cartridge mounting unit" or a "holder") 33 on which the print head 32 and the ink cartridge 1 are removably mounted. In the present embodiment, a head unit (hereinafter also referred to as a "cartridge mounting unit") 38 in which the print head 32 and the mounting portion 33 are integrated is configured to be removably mounted on the carriage 31, as shown in FIG. 5, FIG. 6, etc. which will be described later. The carriage 31 is movable in an X axis direction perpendicular to a direction in which a print medium 37 is conveyed.

The mounting portion 33 provided for the carriage 31 is configured such that ink cartridges 1C, 1Bk, 1M, and 1Y for respectively storing therein inks of cyan (C), black (Bk), magenta (M), and yellow (Y) can be removably mounted. The ink cartridge 1Bk has a greater width and a larger capacity as compared to the other three ink cartridges 1C, 1M, and 1Y. Further, the print head 32 has color head units for individually ejecting inks of cyan (C), black (Bk), magenta (M), and yellow (Y). Each color of ink supplied from the ink cartridge 1 can be ejected from each color head unit.

To remove, mount, or replace the ink cartridge 1 with respect to the carriage 31, a user first opens the outer cover (not shown) that covers the carriage 31, the conveying unit 34, and the like. Upon detection of the open state of the outer cover by the printing apparatus body 30, the carriage 31 moves to a "cartridge replacement position (not shown)". The user can insert the ink cartridge 1 into the carriage 31 in the cartridge replacement position or remove the ink cartridge 1 from the carriage 31 in the cartridge replacement position.

If the user closes the outer cover after removing, mounting, or replacing the ink cartridge 1, the closed state of the outer cover is detected. Upon detection of the closed state, the control unit 35 of the printing device body 30 reads ink color information from the memory element of the ink cartridge mounted on the carriage 31. The control unit 35 determines whether all of the colors (four colors in the present embodiment) of the ink cartridges which should be mounted on the carriage 31 are mounted based on the read ink color information. If it is determined that there is a color of the ink cartridge that is not mounted on the carriage 31, the control unit 35 sends an error display command to the operation unit or the external device to display an error message on a display panel of the operation unit or a display unit of the external device. Meanwhile, if it is determined that all of the colors of the ink cartridges which should be mounted on the carriage 31 are mounted on the carriage 31, the printing apparatus body 30 becomes in a printable condition.

If a printing instruction is input from the external device or the operation unit to the control unit 35, the control unit 35 determines whether the printing apparatus body 30 is under a printable condition. If the printing apparatus body 30 is under a printable condition, the feeding unit (not shown) picks a print medium 37 loaded into the feeding cassette (not shown) and feeds the picked print medium 37 toward the conveying unit 34. The conveying unit 34 includes a platen for supporting the under surface of the print medium, a conveying roller that can intermittently convey the print medium, a driving unit for rotary driving the conveying roller, and the like. The conveying unit 34 conveys the print medium 37 fed by the feeding unit to the discharge tray (not shown). Between one conveying operation and the following conveying operation of the print medium 37, the carriage 31 moves above the print medium in an X direction perpendicular to a direction in which the print medium 37 is conveyed. Ink is ejected from the print head 32 to the print medium 37 during movement of the carriage 31, whereby an image is formed on the print medium. Accordingly, repeating the movement of the carriage along with the conveyance of the print medium can form an image on the print medium.

The present embodiment employs a structure for removably mounting the head unit (cartridge mounting unit) 38 having the print head 32 and the mounting portion 33 on the carriage 31. However, the present invention is not limited to this embodiment. The present invention may take a form in which the print head 32 and the mounting portion 33 are removably mounted on the carriage 31 individually. The mounting portion 33 may be integrated into the carriage 31, and only the print head 32 may be removably mounted on the carriage 31. Furthermore, both of the print head 32 and the mounting portion 33 may be integrated into the carriage 31. In short, the carriage 31 only needs to have a configuration in which the print head 32 can be mounted on the carriage 31 and the ink cartridge 1 is removably mounted on the carriage 31.

It should be noted that the above-described printing apparatus is a printing apparatus of a so-called serial scan type for printing an image while the print head is moved in a main scanning direction and the print medium is conveyed in a sub-scanning direction. However, the present invention may also be applied to a printing apparatus of a full line type using a print head which extends across the entire width of a print medium.

(Configuration of Ink Cartridge)

Next, an example of the ink cartridge 1 mounted on the printing apparatus body 30 of FIG. 1 will be described with reference to FIGS. 2 to 4A and 4B. The four ink cartridges 1C, 1Bk, 1M, and 1Y used in the present embodiment have the same basic configuration other than types of ink stored therein, cartridge widths (the width of the ink cartridge 1Bk is greater than the width of the ink cartridge 1C, 1M, or 1Y), and identification portions 9 (described later). By way of example, the configuration of the ink cartridge 1M will be described.

(Configuration of Housing)

Figure 2:
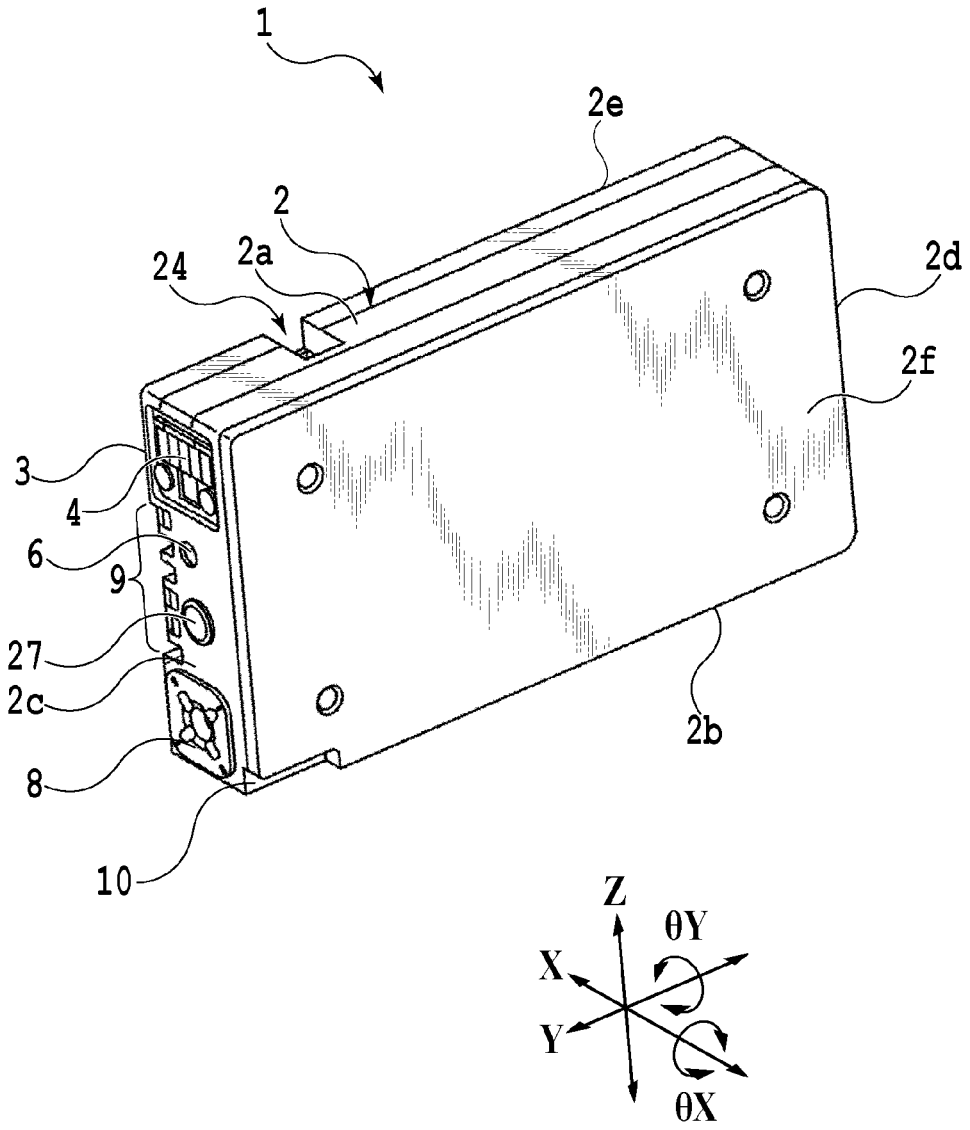
FIG. 2 is a perspective view of the ink cartridge mounted on the ink jet printing apparatus of FIG. 1.

First, a description will be given of the configuration of a housing (housing member) 2 of the ink cartridge 1. FIG. 2 is a perspective view showing an appearance of the ink cartridge 1 that can be applied to the present embodiment. As shown in FIG. 2, the ink cartridge 1 as a liquid storage container has a housing (hereinafter also referred to as a "cartridge body" or a "container body") 2 in a rectangular shape having an ink storage chamber 11 therein.

The housing 2 has a top surface 2*a* which is an outer wall surface of a top wall, an undersurface (bottom surface) 2*b* which is an outer wall surface of a lower wall (bottom wall), a plurality of side surfaces 2*c* to 2*f* which are outer wall surfaces of a plurality of side walls connecting the top wall with the lower wall while the ink cartridge 1 is mounted on the printing apparatus body 30. The housing 2 includes a space inside these outer wall surfaces. In this manner, the top wall (top surface), the bottom wall (bottom surface), and the plurality of side walls (plurality of side surfaces) are defined in an orientation (position) of the ink cartridge 1 mounted on the mounting portion 33, that is, in an orientation (position) of the ink cartridge 1 during use. As used herein, the ink cartridge 1 during use means the ink cartridge 1 being mounted on the carriage 31.

The plurality of side surfaces include a fore surface (front surface) 2*c* which is a first side surface, a rear surface (back surface) 2*d* which is a second side surface, a left surface 2*e* which is a third side surface connecting the first side surface with the second side surface, and a right surface 2*f* which is a fourth side surface connecting the first side surface with the second side surface. The fore surface 2*c* is a surface located on the front side (fore end) in a mounting direction of the ink cartridge. The rear surface (back surface) 2*d* is a surface located on the back side (rear end) in the mounting direction of the ink cartridge 1 and is located opposite to the fore surface 2*c* with respect to the ink storage chamber 11. The left surface 2*e* is a surface located on the left side of the ink cartridge 1 as viewed from the front. The right surface 2*f* is a surface located on the right side of the ink cartridge 1 as viewed from the front and is located opposite to the left surface 2*e* with respect to the ink storage chamber 11.

It should be noted that a first side wall having the first side surface which is the fore surface 2*c* is called a "front wall", a second side wall having the second side surface which is the rear surface 2*d* is called a "back wall", a third side wall having the third side surface which is the left surface 2*e* is called a "left wall", and a fourth side wall having the fourth side surface which is the right surface 2*f* is called a "right wall". The front wall and the back wall face each other with the ink storage chamber therebetween, and the left wall and the right wall face each other with the ink storage chamber therebetween.

In FIG. 2, an X axis direction is a direction corresponding to the width of the ink cartridge 1 and is also a direction in which the ink cartridge moves while being mounted on the carriage 31 (moving direction of the carriage). A Y axis direction is a direction corresponding to the depth of the ink cartridge 1 and is also a mounting direction (inserting direction) and a removing direction (releasing direction) of the ink cartridge 1. A Z axis direction is a direction corresponding to the height of the ink cartridge 1 and a direction perpendicular to the X axis direction and the Y axis direction. Furthermore, a θx direction is a rotation direction around the X axis serving as a rotation center axis, a θy direction is a rotation direction around the Y axis serving as a rotation center axis, and a θz direction is a rotation direction around the Z axis serving as a rotation center axis.

In the present embodiment, since the ink cartridge 1 employs the housing having a rectangular shape, the X axis direction of the ink cartridge 1 is perpendicular to the left surface 2*e* and the right surface 2*f*. Further, the Y axis direction of the ink cartridge 1 is perpendicular to the fore surface (front surface) 2*c* and the back surface 2*d*. The Z axis direction of the ink cartridge 1 is perpendicular to the top surface 2*a* and the undersurface (bottom surface) 2*b*.

It should be noted that the shape of the housing that can be applied to the present embodiment is not limited to the rectangular shape. Other shape can be applied to the present invention. For example, all or part of the surfaces forming the housing may be curved surfaces or inclined surfaces. In a case where all or part of the surfaces forming the housing 2 are curved surfaces or inclined surfaces, the X, Y, and Z axes may not be perpendicular to these surfaces.

(Configuration of Cartridge Interface Portion)

Figure 3:
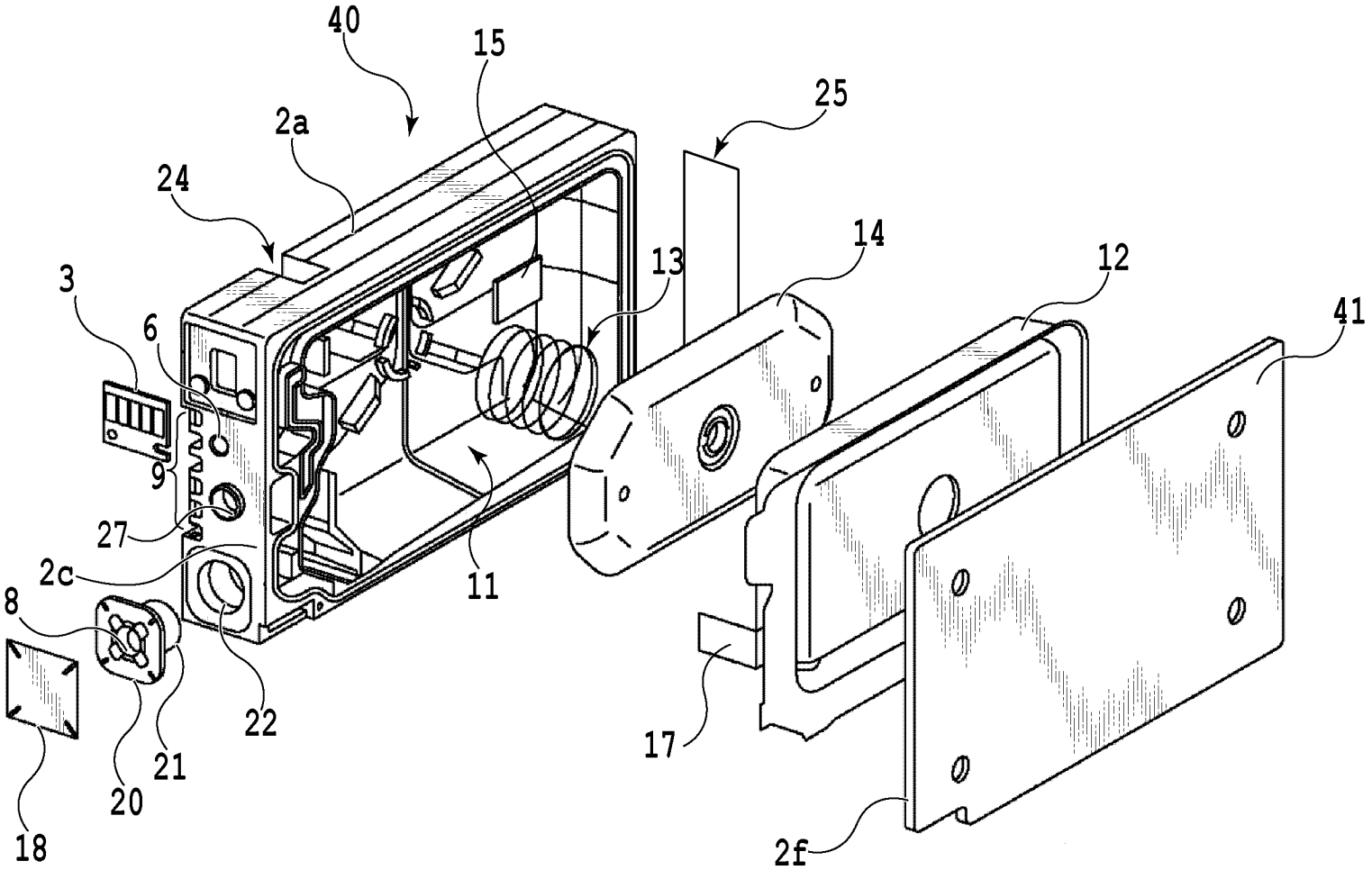
FIG. 3 is an exploded perspective view of the ink cartridge of FIG. 2.
Figure 4A:
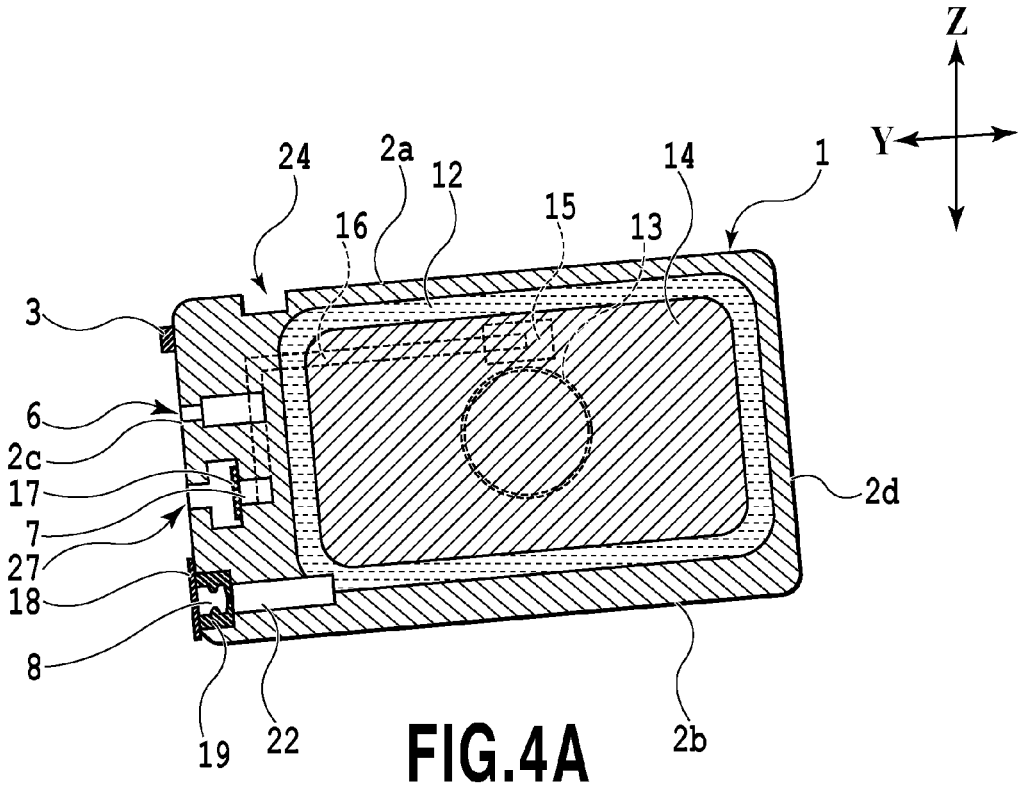
FIG. 4A is a cross-sectional view of the ink cartridge of FIG. 2 as viewed from the side.
Figure 4B:
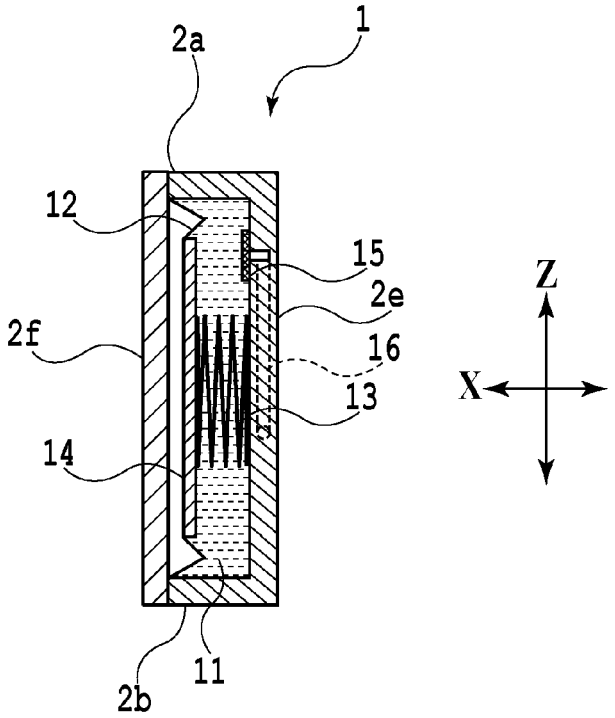
FIG. 4B is a cross-sectional view of the ink cartridge of FIG. 2 as viewed from the front.

FIG. 3 is an exploded perspective view of the portions of the ink cartridge 1. FIG. 4A is a cross-sectional view of the ink cartridge 1 as viewed from the side. FIG. 4B is a cross-sectional view of the ink cartridge 1 as viewed from the front.

As shown in FIGS. 2, 3, 4A, and 4B, the fore surface 2*c* of the housing is provided with a substrate 3 having an electric contact 4 provided thereon, a positioning hole 6 as a positioning portion, a through hole 27 as a through hole portion, a tube insertion port 8 as a tube insertion portion, and an identification portion 9. The electric contact 4, the positioning hole 6, the through hole 27, the tube insertion port 8, and the identification portion 9 serve as a cartridge interface portion that is connected to a printing apparatus body interface portion provided on the mounting portion 33.

Figure 7:
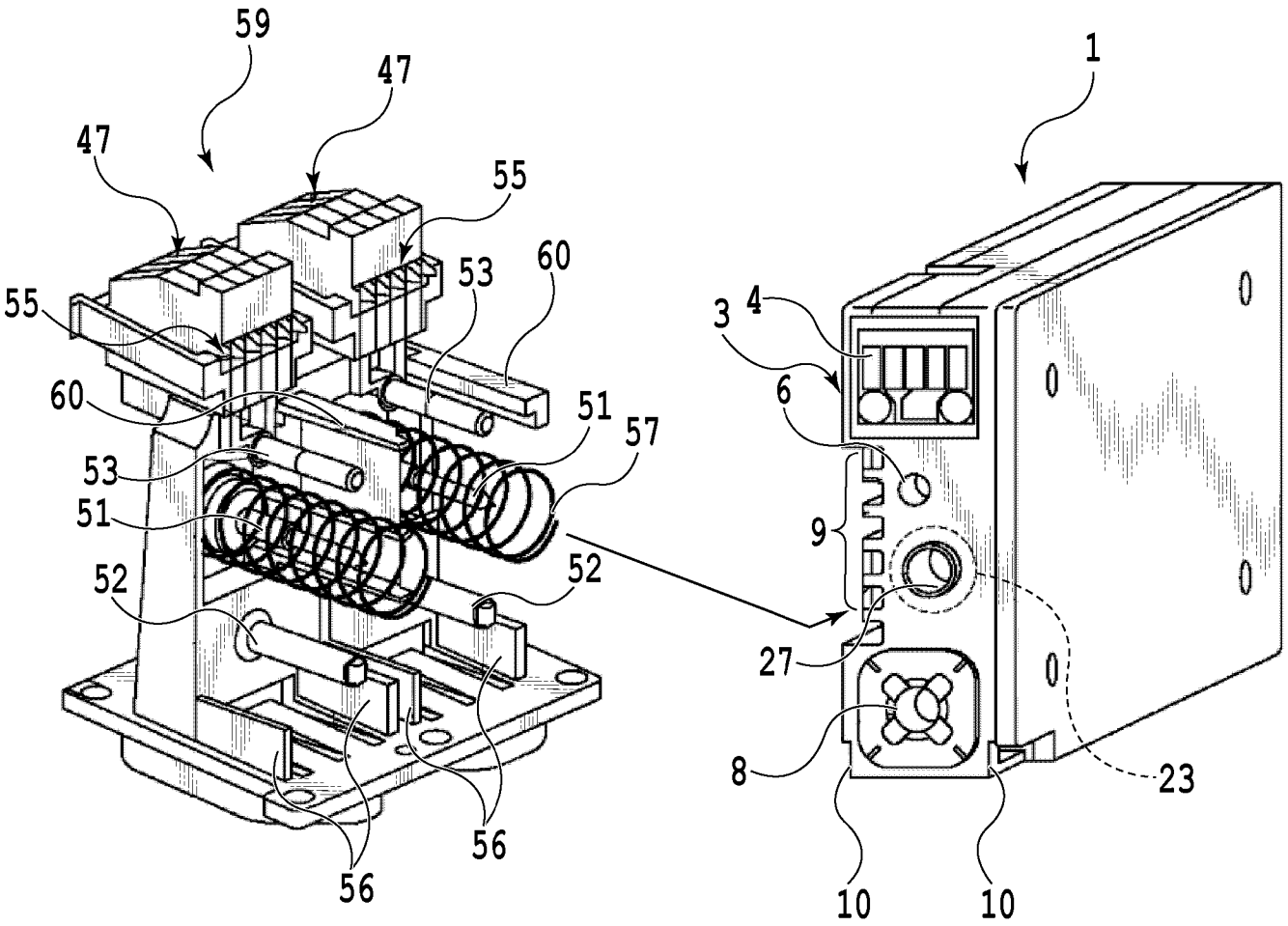
FIG. 7 is a perspective view showing mounting portions of the ink cartridge and the head unit of FIG. 5.

The electric contact 4, the positioning hole 6, the through hole 27, the tube insertion port 8, and the identification portion 9 are respectively connected to an electric connection portion 55, a positioning pin 53, a tear pin 51, an ink receiving tube 52, and an identification member 60 which are included in the printing apparatus body interface portion as shown in FIGS. 6 and 7.

FIG. 6 is a cross-sectional view of the printing apparatus body interface portion of the printing apparatus body 30. FIG. 7 is a perspective view of the printing apparatus body interface portion and is a perspective view of the cartridge interface portion of the ink cartridge 1. Details of the configuration of the printing apparatus body interface portion will be described later.

The configuration of the ink cartridge will now be described with an emphasis on the cartridge interface portion.

As shown in FIGS. 2, 3, 4A, and 4B, the tube insertion port 8 is located near the bottom surface, that is, a lower portion of the fore surface 2*c* of the housing 2 (a portion closer to the bottom surface 2*b* than the top surface 2*a*). The tube insertion port 8 is provided in one end portion of a tube insertion path 22. The other end portion of the tube insertion path 22 is connected to the ink storage chamber 11. The tube insertion path 22 is provided with a seal member 19 made of an elastic body (for example, a ring rubber).

An end portion in the back of the seal member 19 (a side closer to the ink storage chamber 11 than the tube insertion port 8) is provided with a slit that can be open or closed. The slit is closed while the ink receiving tube 52 is not disposed in the slit. While the slit is closed, the tube insertion path 22 is blocked, and the tube insertion port 8 and the ink storage chamber 11 are in a noncommunication state. If the ink receiving tube 52 is inserted into the tube insertion path, the slit is extended and opened to secure communication between the ink receiving tube 52 and the ink storage chamber 11. At this time, to avoid leakage of ink to the outside, the inner peripheral surface of the seal member 19 is elastically in contact with the outer peripheral surface of the ink receiving tube 52. The connection between the ink insertion path 22 and the ink receiving tube 52 in this manner allows the ink in the ink storage chamber 11 to be supplied to the ink receiving tube 52.

When mounting the ink cartridge 1, the ink receiving tube 52 is inserted into the tube insertion port 8. Accordingly, the movement of the ink cartridge 1 in directions along the fore surface 2*c* (X axis and Z axis directions), that is, in-plane directions of the fore surface 2*c*, is limited. In other words, the tube insertion port 8 as a tube insertion portion serves also to reduce positional errors of the ink cartridge 1 in the in-plane directions of the fore surface 2*c*.

In the present embodiment, the tube insertion port (opening) 8 as a tube insertion portion that is formed on the ink cartridge 1 is employed, but the configuration of the tube insertion portion is not limited to the opening. The tube insertion portion does not need to be open before the ink receiving tube 52 is inserted. Any tube insertion portion may be employed as long as the ink receiving tube 52 can be inserted into the tube insertion portion.

The tube insertion portion, the tube insertion port, and the tube insertion path may also be referred to as follows in terms of their functions. For example, the "tube insertion path 22" may also be referred to as a "tube receiving path" since the "tube insertion path 22" is also a portion receiving the ink receiving tube 52. The "tube insertion port 8" may also be referred to as a "tube receiving port" since the "tube insertion port 8" is also an opening located on one end of the tube receiving tube to receive the ink receiving tube 52. The "tube insertion portion" may also be referred to as a "tube receiving portion" since the "tube insertion portion" is also a portion located on one end of the tube receiving tube to receive the ink receiving tube 52.

Further, the "tube insertion path 22" may also be referred to as an "ink supply path" since the "tube insertion path 22" is also a supply path for supplying ink in the ink storage chamber 11 to the outside of the cartridge (ink receiving tube 52). The "tube insertion port 8" may also be referred to as an "ink supply port" since the "tube insertion port 8" is also an opening located on one end of the ink supply path to supply ink in the ink storage chamber 11 to the outside of the cartridge (ink receiving tube 52). The "tube insertion portion" may also be referred to as an "ink supply portion" since the "tube insertion portion" is also a portion located on one end of the ink supply path to supply ink in the ink storage chamber 11 to the outside of the cartridge (ink receiving tube 52).

Further, the "tube insertion path 22" may also be referred to as an "ink discharge path" since the "tube insertion path 22" is also a discharge path for discharging ink in the ink storage chamber 11 to the outside of the cartridge. The "tube insertion port 8" may also be referred to as an "ink discharge port" since the "tube insertion port 8" is also an opening located on one end of the ink discharge path to discharge ink in the ink storage chamber to the outside of the cartridge. The "tube insertion portion" may also be referred to as an "ink discharge portion" since the "tube insertion portion" is also a portion located on one end of the ink discharge path to discharge ink in the ink storage chamber 11 to the outside of the cartridge.

As shown in FIG. 4A, a sealing film 18 as a sealing member is attached to a portion around the tube insertion port 8 so as to cover the tube insertion port 8 before the ink cartridge 1 is mounted on the mounting portion 33, that is, before the ink cartridge 1 is used. The sealing film 18 (hereinafter also referred to as a "tube insertion port sealing film", a "supply port sealing film", or a "tube receiving port sealing film") serves as an ink leakage prevention unit for preventing ink leakage before the use of the cartridge, such as in physical distribution. When the ink cartridge 1 is mounted, the sealing film 18 is unsealed by the ink receiving tube 52.

As shown in FIGS. 3, 4A, and 4B, the ink cartridge 1 is provided with an atmosphere communication port 7 and a through hole 27 for allowing the space inside the ink storage chamber 11 to communicate with the outside. The atmosphere communication port 7 and the through hole 27 are disposed between the tube insertion port 8 and the positioning hole 6 in a direction corresponding to the height of the cartridge. In other words, the atmosphere communication port 7 and the through hole 27 are located higher than the tube insertion port 8 and lower than the positioning hole 6.

Both of the atmosphere communication port 7 and the through hole 27 are a portion into which the tear pin is inserted. The through hole 27 is a through hole provided on the fore surface 2*c* and through which the tear pin 51 can pass. Meanwhile, the atmosphere communication port 7 is an opening provided in one end portion of an atmosphere communication channel 16 and disposed in the back with respect to the through hole 27, more specifically, between the through hole 27 and the ink storage chamber 11 in a direction corresponding to the depth of the cartridge 1. As will be described later, when the ink cartridge 1 is mounted on the mounting portion 33, the tear pin 51 is first inserted into the through hole 27, and then the tear pin 51 that has penetrated the through hole 27 is inserted into the atmosphere communication port 7.

As shown in FIG. 4A, one end portion of the atmosphere communication channel 16 is the atmosphere communication port 7 and the other end portion of the atmosphere communication channel 16 is connected to the ink storage chamber 11. That is, the inside of the ink storage chamber 11 communicates with the atmosphere through the atmosphere communication channel 16 and the atmosphere communication port 7. A connection portion between the atmosphere communication channel 16 and the ink storage chamber 11 is provided with a filter 15 having a meniscus force. Since ink in the ink storage chamber 11 is maintained in the ink storage chamber 11 by the meniscus force of the filter 15, the ink will not leak out to the atmosphere communication channel 16. If the ink is consumed and the negative pressure in the ink storage chamber 11 reaches or exceeds the meniscus force of the filter, air in the atmosphere communication channel is introduced into the ink storage chamber 11 by breaking the meniscus of the filter 15, resulting in a communication state. Under the communication state, air is introduced into the ink storage chamber 11 through the atmosphere communication channel 16 by an amount corresponding to the consumption of the ink in the ink storage chamber 11. This can prevent the negative pressure in the ink storage chamber 11 from being excessively high. Since it is possible to prevent the negative pressure in the ink storage chamber 11 from being excessively high, there will be less difficulty in supplying the ink in the ink storage chamber 11 to the outside. Accordingly, it is possible to reliably supply ink from the ink storage chamber 11 to the outside and to use up almost all of the ink in the ink storage chamber 11.

As shown in FIG. 4A, before the ink cartridge 1 is mounted on the mounting portion 33, that is, before the ink cartridge 1 is used, a sealing film 17 as a sealing member is disposed to cover the atmosphere communication port 7. The sealing film 17 is hereinafter also referred to as an "atmosphere communication port sealing film". The atmosphere communication port sealing film 17 is folded by substantially 90 degrees with respect to a main surface of a flexible member 12 as shown in FIG. 3 and is in close contact with an inner wall edge of a first housing member 40 to cover the atmosphere communication port 7 provided in the first housing member 40. When the ink cartridge 1 is mounted, the atmosphere communication port sealing film 17 is unsealed by the tear pin 51 which is inserted into the atmosphere communication port 7 through the through hole 27. It should be noted that the atmosphere communication port sealing film 17 is integrally formed with the flexible member 12 in the present embodiment, but the configuration of the atmosphere communication port sealing film 17 is not limited to this. For example, the atmosphere communication port sealing film 17 may be formed as a component separate from the flexible member 12.

The atmosphere communication port sealing film 17 serves as a unit for preventing ink evaporation and ink leakage before the use of the cartridge, such as in physical distribution. The timing at which the atmosphere communication port sealing film 17 is unsealed is preferably immediately before the use of the ink cartridge. The present embodiment, therefore, uses a configuration in which the atmosphere communication port sealing film 17 is unsealed by the tear pin 51 of the printing apparatus body, so that the atmosphere communication port sealing film 17 is unsealed at a timing at which the ink cartridge 1 is mounted on the printing apparatus body.

In the present embodiment, as shown in FIG. 4A, the atmosphere communication port sealing film 17 is disposed in the back with respect to the fore surface 2*c*, more specifically, at a position where a user cannot touch. This can prevent the atmosphere communication port sealing film 17 from being removed by the user before the use of the ink cartridge 1.

The identification portion 9 is a portion having a function of mechanically and structurally preventing the ink cartridge 1 from being mounted on an incorrect mounting position (where an ink cartridge of a different color should be mounted). The identification portions 9 have different shapes depending on their ink colors. The identification portion 9 has recesses as shown in FIGS. 2 and 3. The positions of the recesses vary for each color of the ink cartridge 1. To adapt to the identification portion 9, the mounting portion 33 of the ink cartridge 1 is provided with a projection as an identification member 60 (see FIG. 7). The position of the projection varies depending on the mounting portion so that an ink cartridge of a different color cannot be mounted. The identification portion 9 is, as shown in FIGS. 2 and 3, disposed between the tube insertion port 8 and the electric contact 4 in a longitudinal direction (height direction) of the fore surface 2*c* of the housing 2. More specifically, the identification portion 9 is provided in the longitudinal direction and the range of the arrangement is greater than the longitudinal distance between the positioning hole 6 and the through hole 27.

Furthermore, as shown in FIGS. 2 and 3, a portion around the through hole 27 on the fore surface 2*c* of the housing 2 is cylindrically raised. As will be described later, the raised portion and a portion close to the raised portion function as an eject spring contact portion 23 which can be brought into contact with an eject spring 57 provided in the mounting portion 33 (see FIG. 7). The eject spring contact portion 23 indicated by a broken line in FIG. 7 is urged in a cartridge removing direction by the eject spring 57 while the ink cartridge 1 is mounted on the mounting portion 33. More specifically, the eject spring contact portion 23 functions as a force receiving portion which receives from the eject spring 57 an urging force for urging the ink cartridge 1 in the removing direction or a force for moving the ink cartridge 1 in the removing direction (external force). The eject spring contact portion 23 is located between the electric contact 4 and the tube insertion port 8 in the height direction of the cartridge, more specifically, lower than the positioning hole 6 and higher than the tube insertion port 8.

As described above, the fore surface 2*c* of the housing 2 is provided with most of the components of the cartridge interface portion, such as the electric contact 4, the positioning hole (positioning port) 6, the through hole 27, the tube insertion port 8, the identification portion 9, and the eject spring contact portion (force receiving portion) 23. Concentrating the cartridge interface portion makes it possible to also concentrate the printing apparatus body interface portion, whereby the printing apparatus body interface portion can be unitized and downsized.

The cartridge interface portion is provided not only on the fore surface 2*c* of the housing 2 but also on the top surface 2*a* of the housing 2. The top surface 2*a* of the housing 2 is provided with an engagement portion 24 that can engage with an engagement member 54 (see FIG. 6) of an engagement lever 58 provided in the mounting portion 33. As shown in FIGS. 2, 4A, and 4B, the engagement portion is a recess that can engage with an engagement projection as the engagement member 54 to keep the ink cartridge 1 in a mounting completion position against the urging force of the eject spring 57. The engagement portion 24 is a locking portion for fixing the ink cartridge 1 on the cartridge mounting portion 33.

While the engagement portion 24 and the engagement member 54 engage each other (locked state), to keep the ink cartridge 1 in the mounting completion position, the cartridge interface portion and the printing apparatus body interface portion are kept being connected. Examples of the connection state include a connection between the electric contact 4 and the electric connection portion 55. Examples also include a connection (fitted state) between the positioning hole 6 and the positioning pin 53. Examples also include a connection between the tube insertion port 8 and the ink receiving tube 52 (inserted state in which the ink receiving tube 52 is disposed in the tube insertion port 8). Examples also include a connection between the ink storage chamber 11 and the ink receiving tube 52.

Meanwhile, if the engagement (locked state) between the engagement portion 24 and the engagement member 54 is released, the ink cartridge 1 moves in the removing direction by the urging force of the eject spring 57. This causes the connection between the cartridge interface portion and the printing apparatus body interface portion to be released. In this manner, the engagement portion 24 as well as the engagement member 54 serves as a unit for maintaining the connection between the cartridge interface portion and the printing apparatus body interface portion.

As shown in FIGS. 2, 4A, and 4B, the engagement portion 24 is provided on the top surface 2*a* of the housing 2. In the present configuration in which the engagement portion 24 is provided on the top surface 2*a* of the housing 2, it is possible to shorten the distance between the engagement portion 24 and the electric contact 4 as compared to a configuration in which an engagement portion is provided on the bottom surface of the housing. Accordingly, it is possible to minimize the positional error of the electric contact caused by the shift of the locking position. Even if the locking position is shifted, it is possible to achieve a favorable electric connection.

Providing the engagement portion 24 on the top surface 2*a* allows the engagement portion 24 to be disposed closer to the electric contact 4 than the tube insertion port 8. To have a favorable connection with the printing apparatus body, the electric contact 4 has a tolerance for the back-and-forth movement (Y axis direction) that is smaller than that of the tube insertion port 8. More specifically, as compared to the tube insertion port 8, the electric contact 4 requires a higher position precision in the back-and-forth movement (Y axis direction) of the cartridge. Accordingly, it is preferable to design the positional relationship among the engagement portion 24, the tube insertion port 8, and the electric contact 4 such that the electric contact 4 has a smaller amount of the back-and-forth movement along with the movement in the θx direction around the engagement portion 24 than the tube insertion port 8. Therefore, it is preferable to provide the engagement portion 24 on the top surface 2*a*, whereby the engagement portion 24 is provided closer to the electric contact 4 than the tube insertion port 8.

Furthermore, as shown in FIGS. 2, 4A, and 4B, the engagement portion 24 is provided on the top surface 2*a* of the housing 2, closer to the fore surface 2*c* than the back surface 2*d* in the longitudinal direction (depth direction). Since the engagement portion 24 is disposed closer to the electric contact (electrode pad) 4, a length tolerance in the Y axis direction between the engagement portion 24 and the electrode pad 4 can be reduced, and a position tolerance in the back-and-forth direction (Y axis direction) of the electrode pad 4 with respect to the engagement portion 24 when the cartridge is mounted can be reduced. With a small position tolerance in the back-and-forth direction, it is possible to set a small stroke in the back-and-forth direction of the electric connection portion 55.

As shown in FIG. 2, position limiting surfaces 10 provided near the fore surface and the bottom surface on the left surface 2*e* and the right surface 2*f* of the housing are contact surfaces that come into contact with positioning walls 56 of the mounting portion 33 as shown in FIGS. 6, 7, and the like when the ink cartridge is mounted on the mounting portion 33. The position limiting surfaces 10 on the right and left sides come into contact with the positioning walls 56 to function as position limiting units for limiting the movement in the X direction and the θy direction. It should be noted that the ink cartridge 1 of the present embodiment is provided with the position limiting surfaces 10 on the left surface 2*e* and the right surface 2*f*, but the configuration of the position limiting surfaces 10 is not limited to this. For example, two grooves may be formed near the fore surface on the bottom surface 2*b* along the Y axis direction, and side surfaces of the two grooves may act as the position limiting surfaces 10. In short, the position limiting surfaces 10 may be any surfaces as long as a portion near the bottom surface of the ink cartridge 1 comes into contact with the positioning wall 56 and limits the movement in the X direction and the θy direction.

(Configuration of Ink Storage Chamber)

Next, an internal configuration of the ink cartridge will be described with an emphasis on the configuration of the ink storage chamber. FIG. 3 is an exploded perspective view of the ink cartridge of FIG. 2. The housing 2 has the first housing member 40 including the top surface 2*a*, the bottom surface 2*b*, the fore surface 2*c*, the back surface 2*d*, and the left surface 2*e* and a second housing member 41 including the right surface 2*f*. The second housing member 41 serves as a cover member for covering an opening of the first housing member 40. The ink storage chamber 11 is a chamber storing ink in an internal space formed by an inner wall surface of the first housing member 40 and the flexible member 12 (flexible sheet) that is in close contact with the inner wall surface of the first housing member 40. In the present embodiment, the flexible member 12 is attached to a wall surface inside the housing 2 and functions as a defining member that defines a space inside the housing 2. The flexible member 12 is flexible and deformable. While the ink cartridge 1 is being used as mounted on the printing apparatus body 30, the flexible member 12 is attached to protrude from one side surface of the housing 2 toward another side surface of the housing 2, the side surfaces facing each other.

When produced, the flexible member 12 of the ink storage chamber is molded to be convex to project outwardly. Since the flexible member 12 of the ink storage chamber 11 is molded and produced to have such a shape, the flexible member 12 is extended and thinned. This allows the flexible member 12 to be easily deformed by being urged by a negative pressure generation spring 13, and a resistance at the time of deformation is reduced. As a result, the negative pressure generation spring 13 allows the flexible member 12 to be smoothly deformed, and the negative pressure in the flexible member 12 can be stably maintained while stably supplying ink to the print head 32. In molding, it is preferable to use a vacuum molding in which molding is performed by pressing a mold against a film after being warmed and sucking from a mold side, a press molding in which molding is performed by pressing a warmed film with a mold, and the like.

A seal member unit 20 is fitted into the tube insertion path 22 provided in the first housing member 40. The seal member unit 20 includes the seal member 19 which is cylindrical in shape and has a slit that can be open or closed at one end and an opening at the other end and an outer cover 21 integrally formed with the outer peripheral surface of the seal member 19. If the seal member unit 20 is inserted into the tube insertion path 22, the opening at the other end forms the tube insertion port 8.

A space defined by the flexible member 12 in the housing 2 is provided with the ink storage chamber (liquid storage chamber) 11. The ink storage chamber 11 can store ink therein. Inside the ink storage chamber 11, the negative pressure generation spring (urging unit) 13 as a negative pressure generation member and a plate member (moving member) 14 that is smaller than the periphery of the inner wall of the first housing member 40 are provided. One end of the negative pressure generation spring 13 engages with the inner wall of the left surface 2*e* of the first housing member 40, whereas the other end of the negative pressure generation spring 13 engages with the plate member 14. The negative pressure generation spring 13 maintains the negative pressure in the ink storage chamber 11 within a predetermined range by pressing the flexible member 12 from the inside toward the outside and urging the flexible member 12 in a direction in which a volume of the ink storage chamber expands via the plate member 14. As described above, the negative pressure generation spring 13 urges the defining member that defines the space inside the housing 2 containing the flexible member 12 in a direction in which the volume of the ink storage chamber 11 expands. Further, the plate member 14 is attached to the negative pressure generation spring 13 and causes the flexible member 12 to move concurrently with the movement of the plate member 14 by the negative pressure generation spring 13.

Further, the tube insertion path 22 as an ink supply port (liquid supply port) for supplying ink stored in the ink storage chamber 11 to the outside is provided on the bottom surface of the ink storage chamber 11.

In a case where ink in the ink storage chamber 11 decreases by being supplied to the print head 32, the negative pressure in the ink storage chamber 11 tends to significantly increase. At this time, the negative pressure generation spring 13 contracts accordingly and the plate member 14 moves in a direction in which the internal volume of the ink storage chamber 11 decreases, whereby a significant increase in the negative pressure can be suppressed.

Note that a space between the ink storage chamber 11 and the second housing member 41 (non-ink storage space) communicates with the outside of the ink cartridge 1 via a communication channel (not shown) provided on the back wall of the ink cartridge 1 and an air opening 26 (see FIG. 5). More specifically, the back wall of the ink cartridge 1 is provided with a serpentine groove (not shown), and one end of the groove communicates with the non-ink storage space. The other end of the groove communicates with the air opening 26. Then, a label 25 (see FIG. 5) is attached to cover the serpentine groove. FIG. 5 is a perspective view of the ink cartridge 1 and the head unit 38 when the ink cartridge 1 is mounted on the head unit 38. At this time, the groove covered with the label 25 functions as a communication channel for the communication between the above-mentioned non-ink storage space and the air opening 26. Accordingly, if the plate member 14 tries to move in a direction in which the internal volume of the ink storage chamber 11 decreases, air is captured into the space (non-ink storage space) between the ink storage chamber 11 and the second housing member 41 from the air opening 26 via the communication channel (not shown).

Supplying the ink in the ink storage chamber 11 to the print head 32 decreases the pressure in the ink storage chamber 11, thereby to generate a negative pressure in the ink storage chamber 11. At this time, a difference between the pressure in the space between the ink storage chamber 11 and the second housing member 41 and the pressure in the ink storage chamber 11 causes the ink storage chamber 11 to be pressed in a direction in which the ink storage chamber 11 is compressed, thereby shrinking the volume of the ink storage chamber 11 while moving the plate member 14.

As the above-described plate member 14 is moved, the ink is further consumed. If the negative pressure in the ink storage chamber 11 reaches or exceeds a meniscus force of the filter 15, air is introduced into the ink storage chamber 11 from the atmosphere communication channel 16 through the filter 15 as described before. After this, air is introduced from the atmosphere communication channel 16 to the ink storage chamber in an amount corresponding to the ink supplied, and accordingly the negative pressure in the ink storage chamber is kept within a predetermined range. This can keep the pressure in the ink storage chamber 11 in balance and prevent the negative pressure from increasing more than necessary. In this manner, taking in air into the ink storage chamber 11 from the middle of the ink supply allows almost all the ink in the ink storage chamber to be used up.

Figure 8A:
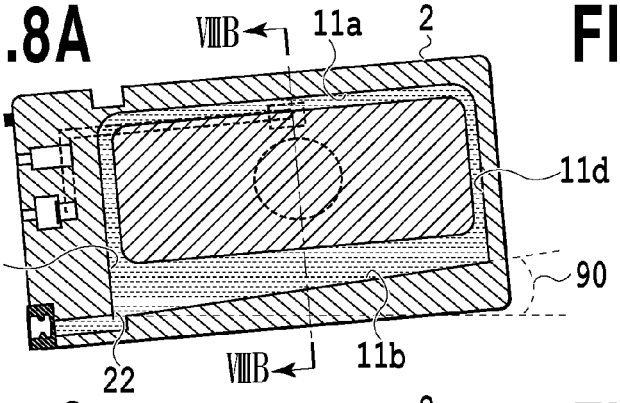
FIGS. 8A to 8H are cross-sectional views individually showing the state of the ink storage chamber as the ink in the ink cartridge of FIG. 2 is consumed.
Figure 8B:
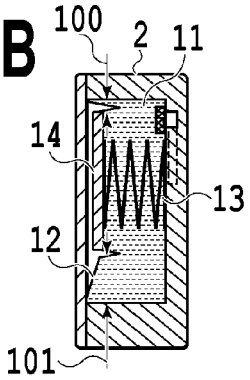
Figure 8C:
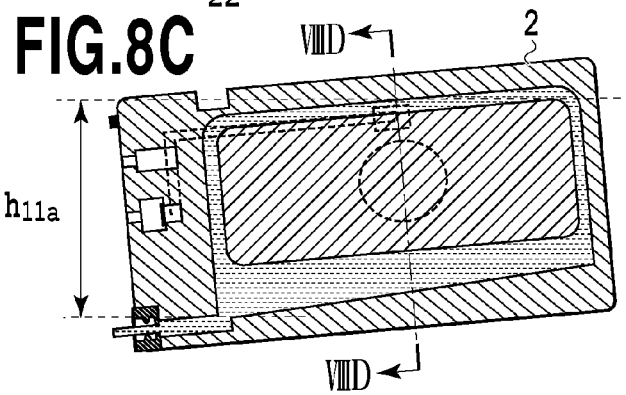
Figure 8D:
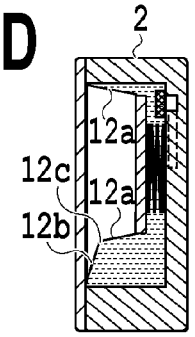
Figure 8E:
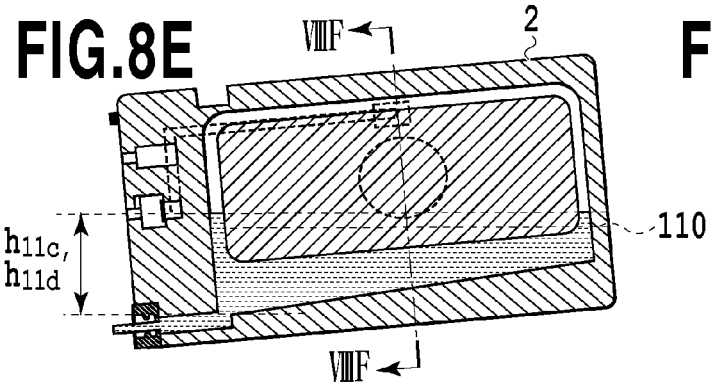
Figure 8F:
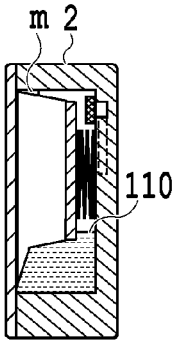
Figure 8G:
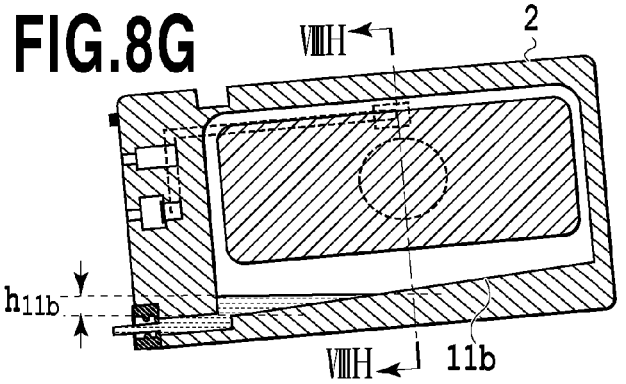
Figure 8H:
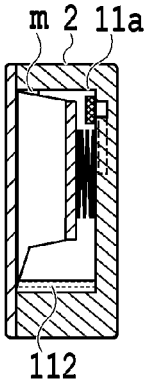

With reference to FIGS. 8A to 8H, the configuration of the ink storage chamber 11 of the ink cartridge 1 according to the present embodiment will be described. FIGS. 8A to 8H are cross-sectional views of the ink cartridge 1 including different amounts of ink in a case where the amount of ink stored in the ink storage chamber 11 changes. FIG. 8A is a cross-sectional view of the ink cartridge 1 in which the ink storage chamber 11 is sufficiently filled with ink. FIG. 8B is a cross-sectional view of the ink cartridge 1 taken along line VIIIB-VIIIB of FIG. 8A. FIG. 8C is a cross-sectional view of the ink cartridge 1 in which the plate member 14 has moved as the ink is consumed as compared to the state shown in FIG. 8A. FIG. 8D is a cross-sectional view of the ink cartridge 1 taken along line VIIID-VIIID of FIG. 8C. FIG. 8E is a cross-sectional view of the ink cartridge 1 in which a liquid level of the ink has lowered as the ink is consumed as compared to the state shown in FIG. 8C. FIG. 8F is a cross-sectional view of the ink cartridge 1 taken along line VIIIF-VIIIF of FIG. 8E. FIG. 8G is a cross-sectional view of the ink cartridge 1 in which the ink remains in a small amount inside the ink storage chamber 11 after being consumed as compared to the state shown in FIG. 8E. FIG. 8H is a cross-sectional view of the ink cartridge 1 taken along line VIIIH-VIIIH of FIG. 8G.

As shown in FIGS. 8A to 8H, the ink storage chamber 11 is defined and formed by the wall surfaces inside the first housing member 40 and the flexible member 12. To maintain the negative pressure in the ink storage chamber 11, the negative pressure generation spring 13 which is urged in a direction in which the volume of the ink storage chamber 11 expands inside the ink storage chamber 11 is provided in the ink storage chamber 11. The negative pressure generation spring 13 is attached to the wall surface inside the first housing member 40 and is configured to expand and contract in a direction perpendicular to the vertical direction. The flexible member 12 is provided with the plate member 14 to partly move the flexible member 12 by an urging force by the negative pressure generation spring 13.

As the ink in the ink cartridge 1 is consumed, the negative pressure in the ink storage chamber 11 increases and the plate member 14 moves in a direction in which the volume of the ink storage chamber 11 decreases while the flexible member 12 being deformed to shrink the volume of the ink storage chamber 11. At this time, as shown in FIGS. 8C and 8D, the plate member 14 moves closer to the wall surface of the first housing member 40.

The plate member 14 moves closer to the wall surface of the first housing member 40 as the ink is consumed, and when the ink storage chamber 11 is shrunk, air starts to be introduced from the outside of the ink storage chamber 11 to the inside of the ink storage chamber 11. Once the air is introduced from the outside to the inside of the ink storage chamber 11, an area filled with air is formed in the ink storage chamber 11 as shown in FIGS. 8E and 8F.

As the ink is further consumed and air is further introduced into the ink storage chamber 11, a volume of the area filled with air in the ink storage chamber 11 increases and a liquid level of ink 110 moves in the vertical downward direction. As the ink in the ink storage chamber 11 is consumed, the ink only in a small amount remains in the ink storage chamber 11 as shown in FIGS. 8G and 8H. As the ink is further consumed, and when the ink supply from the ink storage chamber 11 to the tube insertion path 22 stops and air starts to flow into the tube insertion path 22, it is determined that the ink storage chamber 11 has become empty of the ink.

At this time, as shown in FIGS. 8F and 8H, an ink m may remain in a gap 100 between the wall surface inside the first housing member 40 and the flexible member 12 in an upper portion of the ink storage chamber 11. In the upper portion of the ink storage chamber 11, a gap between the flexible member 12 and the wall surface inside the first housing member 40 is relatively small and an angle defined by a surface of the flexible member 12 and the wall surface inside the first housing member 40 is relatively small. Therefore, a meniscus force of the ink present in the gap between these surfaces is relatively large.

Figure 9A:
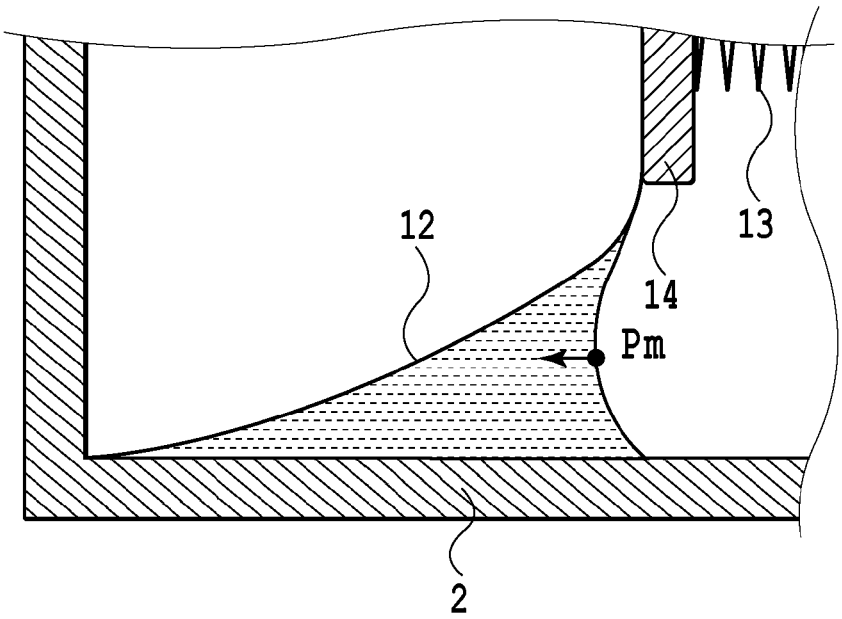
FIG. 9A is a cross-sectional view showing a meniscus force occurring in a liquid surface of ink while a relatively large amount of ink remains in the ink cartridge of FIG. 2.
Figure 9B:
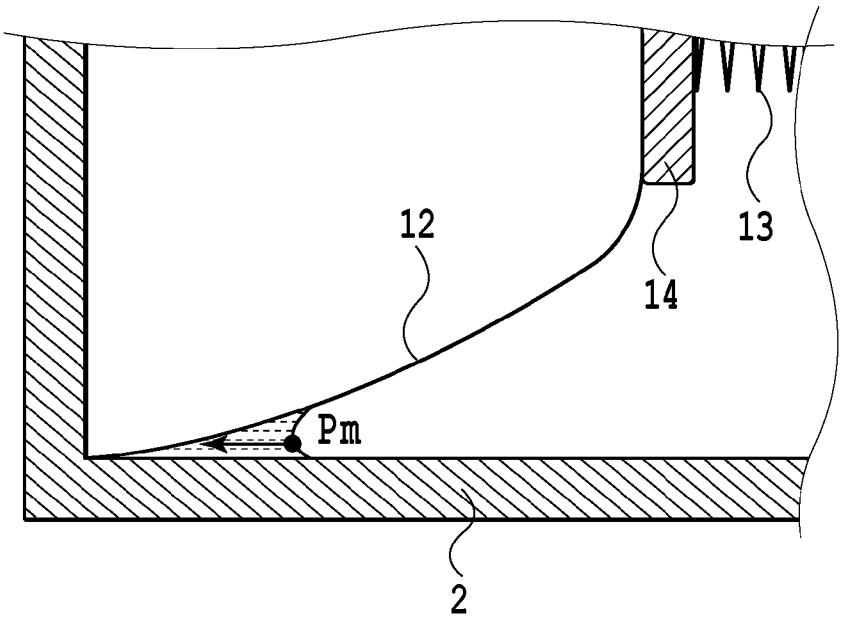
FIG. 9B is a cross-sectional view showing a meniscus force occurring in a liquid surface of ink while a relatively small amount of ink remains in the ink cartridge of FIG. 2.

Usually, a liquid present in an area between two surfaces has a smaller meniscus force in a liquid surface as the distance of the gap between the two surfaces is longer, and has a greater meniscus force in a liquid surface as the distance of the gap between the two surfaces is shorter. FIG. 9A shows a cross section of the ink cartridge 1 while ink remains in a relatively large amount in a space between the plate member 14 and the bottom surface of the ink storage chamber 11. FIG. 9B shows a cross section of the ink cartridge 1 while ink has been consumed and not much ink remains in the space between the plate member 14 and the bottom surface of the ink storage chamber 11.

In the state shown in FIG. 9A, since the ink remains in a relatively large amount in the ink storage chamber 11, the liquid level of the ink is located where the length of the gap between the flexible member 12 and the housing 2 is relatively long. Since the liquid level of the ink is located where the length of the gap between two surfaces is relatively long, a meniscus force Pm in the liquid level is relatively small. Meanwhile, in the state shown in FIG. 9B, since not much ink remains in the ink storage chamber 11, the liquid level of the ink is located where the length of the gap between the flexible member 12 and the housing 2 is relatively short. Since the liquid level of the ink is located where the length of the gap between two surfaces is relatively short, a meniscus force Pm in the liquid level is relatively large. If the meniscus force Pm in the liquid level is large, a force to draw ink in a direction toward the inside of the gap between two surfaces is great, and accordingly the ink tends to remain in the gap between two surfaces, and the ink is less likely to flow toward the tube insertion path 22 from the gap. If the meniscus force Pm in the liquid level is small, a force to draw ink inside is relatively small, and accordingly the ink relatively easily flows toward the tube insertion path 22 from the gap according to a head difference of the ink in each position.

A meniscus of the ink remaining in the gap 100 between the wall surface inside the first housing member 40 and the flexible member 12 in the upper portion of the ink storage chamber 11 is converted into a value based on dimension of length and is represented by Hm. As shown in FIG. 8C, a head difference between an inner top surface 11*a* of the first housing member 40 and the tube insertion path is represented by $h_{11a}$. As shown in FIG. 8E, a head difference between an inner fore surface 11*c* of the first housing member 40, which is a midpoint of the height in the ink storage chamber 11, and the tube insertion path 22 is represented by $h_{11c}$. Likewise, a head difference between an inner back surface 11*d* of the first housing member 40, which is a midpoint of the height in the ink storage chamber 11, and the tube insertion path 22 is represented by $h_{11d}$.

If a head difference h in each position exceeds a value Hm obtained by converting a meniscus force of the ink in each position, the ink in the position flows into the tube insertion path 22 and is supplied to the print head 32 through the tube insertion path 22. Here, Hm is obtained by dividing a meniscus force Pm, that is, a pressure of ink, by the product of an ink density p and an acceleration of gravity g and converting its dimension into dimension of length. This is expressed by $Hm=Pm/\rho g$.

Since the head difference $h_{11a}$ between the inner top surface 11*a* and the tube insertion path 22, the head difference $h_{11c}$ between the inner fore surface 11*c* and the tube insertion path 22, and the head difference $h_{11d}$ between the inner back surface 11*d* and the tube insertion path 22 are relatively large, the head differences $h_{11a}$, $h_{11c}$, and $h_{11d}$ generally exceed the value Hm obtained by converting the meniscus force of the ink to convert its dimension in their respective positions. Accordingly, in these positions, a large amount of ink flows into the tube insertion path 22 and is supplied to the print head 32 through the tube insertion path 22. However, an ink m remains only where the value Hm obtained by converting the meniscus force of the ink to convert its dimension is large. The amount of the remaining ink m is very small.

In the present embodiment, the ink storage chamber 11 is formed so that, in many positions, the head difference h in each position exceeds the value Hm obtained by converting the meniscus force of the ink to convert its dimension.

In the present embodiment, as particularly shown in FIGS. 8A to 8H, a bottom surface inside lib is inclined so as to be gradually lower toward the tube insertion path 22. By forming the ink storage chamber 11 in such a manner, a resistance of an ink flow toward the tube insertion path decreases, allowing the ink to flow smoothly. Accordingly, it is possible to prevent the ink flow by the head difference h from decreasing due to the resistance, and since the head difference h exceeds the value Hm obtained by converting the meniscus force of the ink to convert its dimension, a larger amount of ink flows toward the tube insertion path 22. Accordingly, a larger amount of ink is supplied to the print head 32 and the amount of ink remaining in the ink storage chamber 11 can be reduced.

In the present embodiment, the flexible member 12 is provided so as to face both the first housing member 40 and the second housing member 41. The flexible member 12 is attached to the first housing member 40 and the second housing member 41 so that an edge portion of the flexible member 12 is interposed between the first housing member 40 and the second housing member 41 when the first housing member 40 and the second housing member 41 are adhesively fixed.

The flexible member 12 is formed to be convex from a side surface on which the flexible member 12 is attached between the first housing member 40 and the second housing member 41 toward an opposite side surface. The flexible member 12 is attached to have angles inside the ink storage chamber 11, from portions in which the first housing member 40 and the second housing member 41 are adhesively fixed, with respect to the top surface and the undersurface of the first housing member 40. In the present embodiment, while the ink cartridge 1 is mounted on the ink jet printing apparatus, an attachment angle of the flexible member 12 to the housing in a lower portion is greater than an attachment angle of the flexible member 12 to the housing in an upper portion.

Figure 10A:
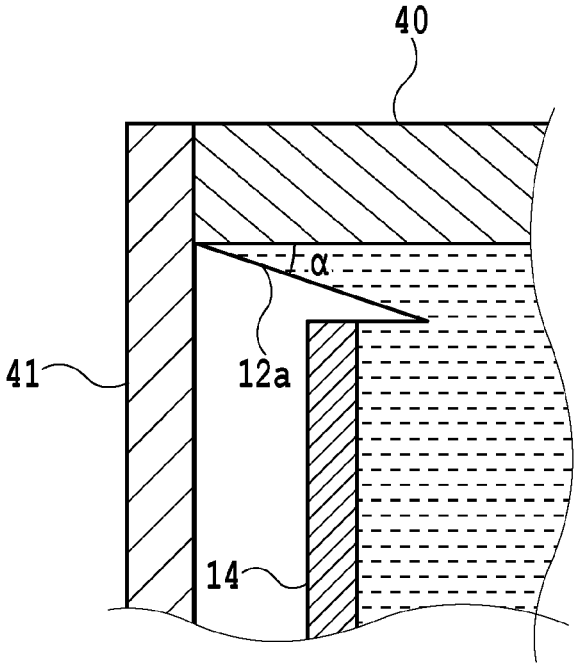
FIG. 10A is a cross-sectional view showing an upper attachment position of a flexible member 12 to a housing in the ink cartridge of FIG. 2.
Figure 10B:
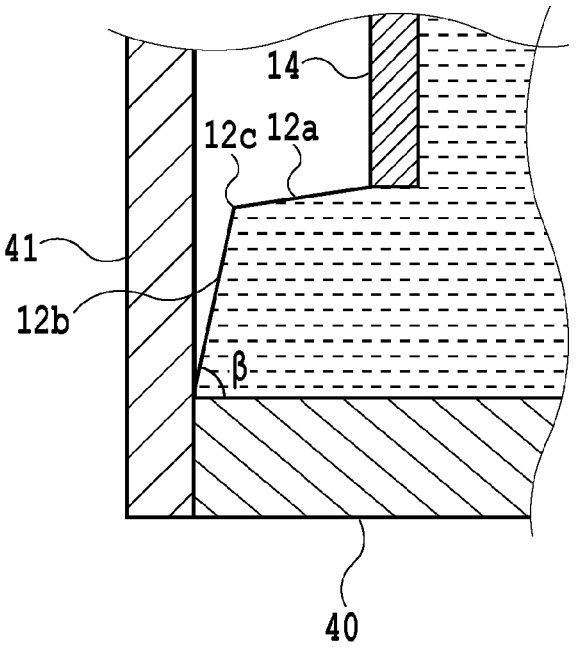
FIG. 10B is a cross-sectional view showing a lower attachment position of the flexible member 12 to the housing in the ink cartridge of FIG. 2.

FIG. 10A is an enlarged cross-sectional view showing an upper attachment position of the flexible member 12, in which the flexible member 12 inwardly extends from the position between the first housing member 40 and the second housing member 41. FIG. 10B is an enlarged cross-sectional view showing a lower attachment position of the flexible member 12, in which the flexible member 12 inwardly extends from the position between the first housing member 40 and the second housing member 41. As shown in FIG. 10A, an angle $\alpha$ is defined by the upper attachment portion of the flexible member 12 inwardly extending from the position between the first housing member 40 and the second housing member 41 and the upper wall surface of the first housing member 40. As shown in FIG. 10B, an angle $\beta$ is defined by the lower attachment portion of the flexible member 12 inwardly extending from the position between the first housing member 40 and the second housing member 41 and the lower wall surface of the first housing member 40.

The flexible member 12 may be deformed as it is flexible, but as used herein, an angle in the attachment position of the flexible member 12 refers to an average angle from the attachment position to a fold.

In the present embodiment, the flexible member 12 is provided so that the plate member 14 is captured by the attachment portion to the first housing member 40 and the second housing member 41 in the flexible member 12 protruding toward the wall surface of the opposite side wall. Accordingly, in the cross section of the ink cartridge 1 along the vertical direction, the attachment portion to the first housing member 40 and the second housing member 41 in the flexible member 12 includes both the upper attachment position and the lower attachment position. Of these positions, an attachment angle of the flexible member 12 to the housing in the lower attachment position is greater than an attachment angle of the flexible member 12 to the housing in the upper attachment position.

In the present embodiment, in particular, the lower attachment position of the flexible member 12 to the housing 2 is located lower than the plate member 14. The upper attachment position of the flexible member 12 to the housing 2 is located higher than the plate member 14.

In the cross section along the vertical direction as viewed from the front, the angle β defined by the lower attachment portion of the flexible member 12 and the lower wall surface of the first housing member 40 is greater than the angle α defined by the upper attachment portion of the flexible member 12 and the upper wall surface of the first housing member 40. Since the attachment angle β in the lower portion of the flexible member 12 is set to be larger, the value Hm obtained by converting the meniscus force of the ink to convert its dimension in the lower portion is relatively small. Therefore, the head difference h of the ink in the lower surface in which the ink is relatively less likely to flow is easy to exceed the value Hm obtained by converting the meniscus force of the ink. Since the ink present in the upper portion of the ink storage chamber 11 has a relatively large head difference h, the ink relatively easily flows downward and a large amount of ink flows toward the tube insertion path 22.

In this manner, since the head difference h is relatively large in the upper portion of the ink storage chamber 11, the ink present in the upper portion of the ink storage chamber 11 relatively easily flows toward the tube insertion path 22. In the upper portion of the ink storage chamber 11, the ink flows toward the tube insertion path 22 even if the meniscus force in the liquid surface of the ink is not so small.

In the lower portion of the ink storage chamber 11, since the head difference h is relatively small, the ink is relatively less likely to flow toward the tube insertion path 22. A small amount of ink may remain in the space between the flexible member 12 and the housing 2. Therefore, it is preferable that the meniscus in the liquid surface of the ink be small in the lower position in the ink storage chamber 11. In the present embodiment, the attachment angle of the flexible member 12 to the housing 2 in the lower attachment position is greater than the attachment angle of the flexible member 12 to the housing 2 in the upper attachment position. Therefore, it is possible to set a relatively large gap between the flexible member and the housing 2 in the lower position in the ink storage chamber 11 and to set a small meniscus force in the liquid surface of the ink in the ink storage chamber 11. This allows the ink to easily flow in the lower position of the ink storage chamber 11 in which the ink is less likely to flow. Accordingly, it is possible to cause the ink in a larger amount to flow toward the tube insertion path 22 both in the upper and lower positions of the ink storage chamber 11. As a result, in general, the ink can easily flow toward the tube insertion path 22. The ink in a larger amount can flow toward the tube insertion path 22 and the amount of the ink remaining in the ink storage chamber 11 can be reduced.

Further, in the present embodiment, a bending part 12*c* of the flexible member 12 is formed below the plate member 14. Since the bending part 12*c* of the flexible member 12 bends below the plate member 14, it is possible to keep the angle β defined by the lower attachment portion of the flexible member 12 and the lower wall surface of the first housing member 40 to be large. More specifically, the flexible member 12 bends in a direction in which an angle between the wall surface inside the housing 2 and the flexible member 12 in the lower attachment position of the flexible member 12 to the housing 2 increases.

In the present embodiment, the thickness of the flexible member 12 varies depending on the positions in the flexible member 12 so that the flexible member 12 is provided with the bending part 12*c*. Since a formation part 12*a* in the upper portion of the flexible member 12 and a formation part 12*a* in the lower portion in the proximity of the plate member 14 are formed to be thin, they are relatively easily deformed. Further, since a formation part 12*b* in the lower portion of the flexible member 12 in the proximity of the wall surface of the first housing member 40 is formed to be thick, it is very rigid and less likely to be deformed. In this manner, in the present embodiment, the thickness of the flexible member 12 varies depending on the positions, and the flexible member 12 bends at the positions where the thickness of the flexible member 12 changes. Further, the flexible member 12 is formed to be thick in the lower attachment position of the flexible member 12 to the housing 2, and above the bending part 12*c* in which the flexible member 12 bends, the flexible member is formed to be thinner as compared to the lower attachment position of the flexible member 12 to the housing 2.

Therefore, even if the ink storage chamber 11 is filled with ink, the formation part 12*b* in the proximity of the lower wall surface is less likely to be deformed, and the shape of the formation part 12*b* is retained. Since the shape of the formation part 12*b* is retained even if the ink storage chamber 11 is filled with ink, it is possible to retain the shape while securing a relatively large gap between the formation part 12*b* of the flexible member 12 and the lower wall surface of the first housing member 40. The angle β defined by the tangent of a portion extending from the position between the first housing member 40 and the second housing member 41 in the lower portion of the flexible member 12 and the lower wall surface of the first housing member 40 is kept to be relatively large.

Since the angle defined by the formation part 12*b* and the lower wall surface of the first housing member 40 is large and a relatively large gap is formed between the formation part 12*b* and the lower wall surface of the first housing member 40, the meniscus force of the ink present in the lower portion of the ink storage chamber 11 is small. Therefore, the value Hm obtained by converting the meniscus force of the ink to convert its dimension can be kept small. Since the value Hm obtained by converting the meniscus force of the ink to convert its dimension in the lower position in which the ink is less likely to flow can be kept small, it is possible to increase the amount of the ink flowing in the lower portion. Since the value Hm obtained by converting the meniscus force of the ink to convert its dimension can be kept small, the head difference h of the ink in a larger amount exceeds the value Hm obtained by converting the meniscus force of the ink to convert its dimension. Accordingly, a larger amount of ink can flow toward the tube insertion path 22. Therefore, it is possible to supply a larger amount of ink to the print head 32, and to reduce the amount of ink remaining in the ink storage chamber 11.

Furthermore, since the formation part 12*b* is formed to have a relatively large thickness, gas permeability of the part is relatively low. In physical distribution, such as the case where the ink cartridge 1 is left for a long period of time, a partial pressure difference between vapor inside the ink storage chamber and vapor outside the ink storage chamber may cause the gas to enter the ink storage chamber 11. The gas enters an area in which gas is collected in the ink storage chamber 11. Depending on the amount of the gas, the entry of gas may cause some problems.

Therefore, the position of the ink cartridge 1 is reversed in physical distribution with respect to the position during use so as to upwardly dispose the formation part 12*b* formed to be relatively thick in the flexible member 12. A portion in which gas is collected inside the ink storage chamber can be located to a portion surrounded by the formation part 12*b* which is formed to be relatively thick. Collecting gas near the formation part 12*b* which is formed to be relatively thick can suppress entry of outside gas into the portion, in which gas is collected inside the flexible member 12, in the ink storage chamber 11. Accordingly, the entry of gas into the ink storage chamber via the flexible member 12 can be suppressed more reliably.

In this manner, according to the ink cartridge 1 of the present embodiment, it is possible to more reliably supply a larger amount of ink stored in the ink storage chamber 11 to the print head 32. That is, it is possible to use the ink in the ink cartridge 1 more efficiently. Further, it is possible to minimize the amount of ink remaining in the ink cartridge 1 when the ink stored in the ink cartridge 1 is used up. Since it is possible to minimize the amount of ink remaining in the ink cartridge 1 when the ink stored in the ink cartridge 1 is used up, it is possible to reduce the amount of ink to be discarded of the ink stored in the ink cartridge 1. Since the amount of ink to be discarded can be reduced, it is possible to reduce the ink consumption. Since it is possible to reduce the replacement frequency of the ink cartridge 1 after the ink is used up, an operation cost of printing can be reduced. In addition, since the replacement frequency of the ink cartridge 1 can be reduced, it is possible to reduce the number of replacements by a user. Therefore, inconvenience for the user can be reduced.

Figure 11A:
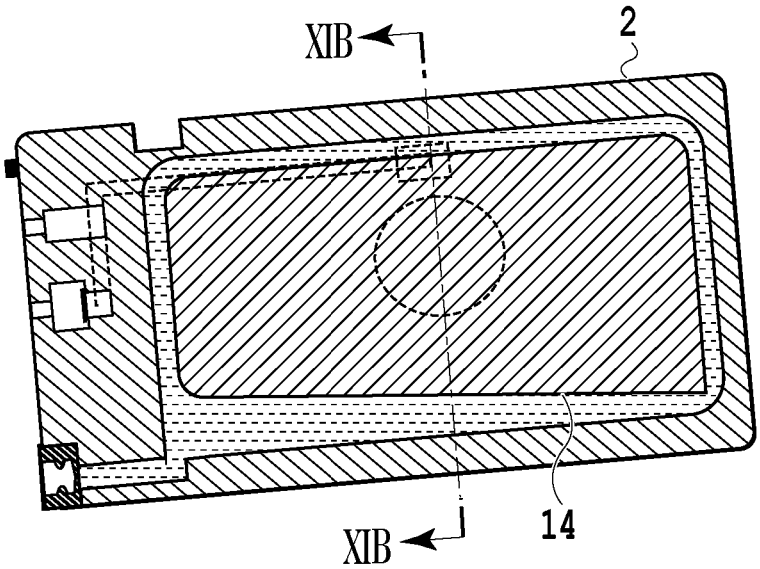
FIG. 11A is a cross-sectional view showing the shapes of an ink storage chamber and a plate member in an ink cartridge according to another embodiment.
Figure 11B:
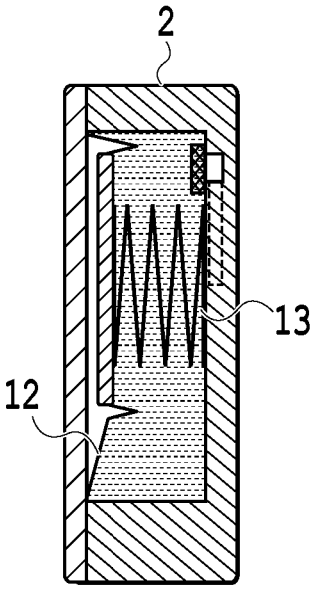
FIG. 11B is a cross-sectional view taken along line XIB-XIB of FIG. 11A.

In the above embodiment, as the configuration in which the head difference h in each position is set larger than the meniscus force Hm in the corresponding position inside the ink storage chamber 11, the ink storage chamber 11, the flexible member 12, and the plate member 14 are arranged as shown in FIGS. 8A to 8H. However, the present invention is not limited to the above embodiment. As shown in FIGS. 11A and 11B, the bottom surface of the ink storage chamber 11 in the first housing member 40 may be formed to be horizontal while the lower wall surface (bottom surface) of the plate member 14 may be inclined to be gradually higher as a distance to the tube insertion path 22 decreases.

More specifically, the wall surface formed opposite to the tube insertion path 22 in the plate member 14 may be inclined to be gradually higher as the distance to the tube insertion path 22 decreases. FIG. 11A is a cross-sectional view of the ink cartridge, as viewed from the side, in which the wall surface formed opposite to the tube insertion path 22 in the plate member 14 is inclined to be gradually higher as the distance to the tube insertion path 22 decreases. Further, FIG. 11B is a cross-sectional view taken along line XIB-XIB of the ink cartridge of FIG. 11A. By forming the plate member 14 in this manner, as the distance to the tube insertion path 22 decreases, a distance between the lower bottom surface of the plate member 14 and the bottom surface of the first housing member 40 increases. Therefore, it is possible to suppress a resistance of an ink flow in the position closer to the tube insertion path 22, and a larger amount of ink can more reliably flow toward the tube insertion path 22.

The ink cartridge 1 may have a configuration in which the bottom surface of the ink storage chamber 11 lowers as the distance to the tube insertion path 22 decreases while the height of the bottom surface of the plate member 14 increases. This allows the ink to be easily flow near the tube insertion path 22, and a larger amount of ink can be more reliably supplied to the print head 32.

In the above-described embodiment as shown in FIGS. 8A to 8H, the plate member 14 has an axisymmetric shape along the Y axis with respect to the center axis, but in an embodiment as shown in FIGS. 11A and 11B, the plate member 14 has a non-axisymmetric shape along the Y axis. Accordingly, when the plate member 14 is attached to the ink cartridge 1, it is necessary to consider the orientation of the plate member 14.

In the above embodiment, a description has been given of the configuration in which the flexible member 12 is attached between the first housing member 40 and the second housing member 41. However, the present invention is not limited to this, and the flexible member 12 may be attached only to either the first housing member 40 or the second housing member.

Figure 12A:
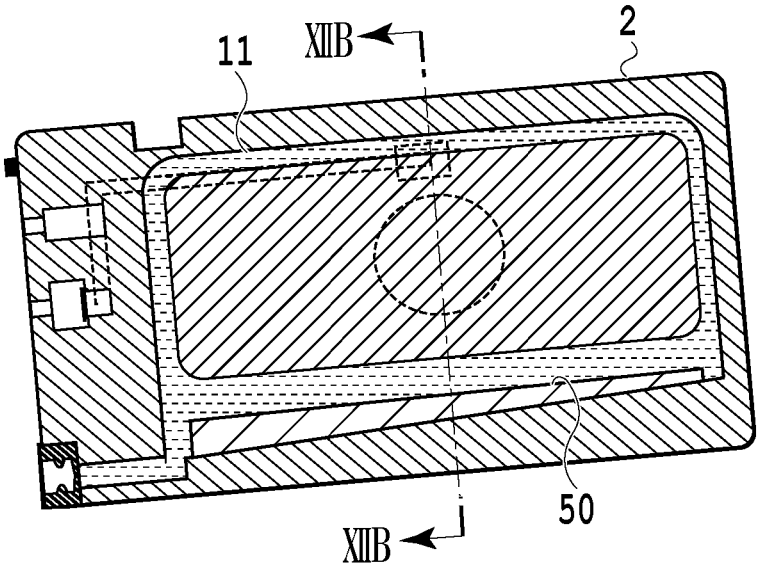
FIG. 12A is a cross-sectional view showing the shapes of an ink storage chamber and a plate member in an ink cartridge according to still another embodiment.
Figure 12B:
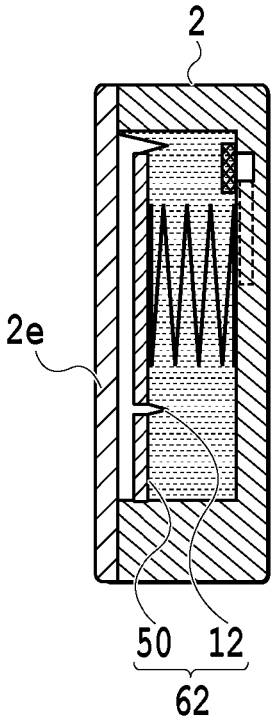
FIG. 12B is a cross-sectional view taken along line XIIB-XIIB of FIG. 12A.

As shown in FIGS. 12A and 12B, the first housing member 40 or the second housing member 41 may be provided with a wall 50, and the flexible member 12 may be attached to the wall 50. In the embodiment shown in FIGS. 12A and 12B, the flexible member 12 is attached to the wall 50 provided to extend upwardly from the bottom surface of the ink storage chamber 11 in the first housing member 40. Here, the wall 50 provided on the housing 2 and the flexible member 12 function as a defining member 62 that defines a space inside the housing 2. FIG. 12A is a cross-sectional view of the ink cartridge, as viewed from the side, in which the space inside the housing 2 is defined by the defining member 62 including the wall 50 provided on the bottom surface of the housing 2 and the flexible member 12. FIG. 12B is a cross-sectional view taken along line XIIB-XIIB of the ink cartridge of FIG. 12A. Since the wall 50 is attached to extend upwardly from the bottom surface of the ink storage chamber 11 in the first housing member 40, the wall 50 is provided so that the bottom surface of the ink storage chamber 11 and the wall 50 form a right angle.

Since the bottom surface of the ink storage chamber 11 and the wall 50 form a right angle, this angle is greater than an angle defined by the flexible member 12 and the wall surface of the ink storage chamber 11 in the upper attachment position of the flexible member 12 to the first housing member 40 and the second housing member 41. Accordingly, since the meniscus force can be suppressed in the lower portion, the head difference h of ink in a larger amount exceeds the value Hm obtained by converting the meniscus force of the ink to convert its dimension. Accordingly, a larger amount of ink can flow toward the tube insertion path 22. Therefore, a larger amount of ink can be supplied to the print head 32 and the amount of ink remaining in the ink storage chamber 11 can be reduced.

To efficiently supply ink from the ink storage chamber 11 to the print head 32, there may be an idea that angles between the upper and lower attachment portions of the flexible member 12 and the wall surface of the first housing member 40 are set large. However, if the angles between the upper and lower attachment portions of the flexible member and the wall surface of the first housing member 40 are set large, the distance between the flexible member 12 and the first housing member 40 increases when the ink storage chamber 11 is decompressed to be filled with ink. Therefore, when ink is filled into the ink storage chamber 11, air may not be sufficiently removed from the ink storage chamber 11, and a relatively large amount of air may remain in the ink storage chamber 11.

If air remains in the ink storage chamber 11, air may expand depending on environmental changes such as decompression. In a case where a volume of the ink storage chamber 11 is not sufficient for the air expansion, the ink storage chamber 11 may be pressurized by the air expansion, and the negative pressure in the ink storage chamber 11 and the negative pressure in the print head 32 may lose its balance.

Accordingly, ink may leak out of ejection ports of the print head 32. To keep the negative pressure in the ink storage chamber 11 and the negative pressure in the print head 32 in balance, it is preferable that not much air remains in the ink storage chamber 11 when the ink storage chamber 11 is decompressed to fill ink into the ink storage chamber 11. Further, in the upper portion of the ink storage chamber 11, air tends to remain particularly when ink is filled into the ink storage chamber 11. Therefore, to prevent air from easily remaining when ink is filled into the ink storage chamber 11, in the upper portion of the ink storage chamber 11, it is preferable that an angle between the attachment portion of the flexible member 12 and the wall surface of the first housing member 40 be set small.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-132860 filed Jun. 27, 2014, which is hereby incorporated by reference wherein in its entirety.

What is claimed is:

1. A liquid storage container comprising:

a housing member having a space therein;

a defining member attached to a wall surface inside the housing member to define the space and including a flexible member having flexibility;

a liquid storage chamber provided in the space defined and capable of storing a liquid therein; and an urging unit configured to urge the defining member in a direction in which a volume of the liquid storage chamber expands, wherein in a position during use, an angle, on the liquid storage chamber side, as between the wall surface inside the housing member and the defining member in a lower attachment position of the defining member to the housing member, is greater than an angle, on the liquid storage chamber side, as between the wall surface inside the housing member and the defining member in an upper attachment position of the defining member to the housing member.

2. The liquid storage container according to claim 1, wherein in the position during use, a liquid supply port for supplying a liquid stored in the liquid storage chamber to the outside is provided on a bottom surface of the liquid storage chamber.

3. The liquid storage container according to claim 2, wherein in the position during use, the bottom surface is inclined to be gradually lower as the distance to the liquid supply port decreases.

4. The liquid storage container according to claim 1, wherein in the position during use, the defining member is attached to one side surface of the housing member so as to protrude toward the other side surface opposite to the side surface.

5. The liquid storage container according to claim 1, comprising a moving member attached to the urging unit and configured to cause the defining member to move when the moving member is moved by the urging unit.

6. The liquid storage container according to claim 5, wherein the lower attachment position of the defining member to the housing member is lower than the moving member, and wherein the upper attachment position of the defining member to the housing member is higher than the moving member.

7. The liquid storage container according to claim 5, wherein in the position during use, the liquid supply port for supplying the liquid stored in the liquid storage chamber to the outside is provided on the bottom surface of the liquid storage chamber, and wherein a wall surface of the moving member formed opposite to the liquid supply port is inclined to be gradually higher as the distance to the liquid supply port decreases.

8. The liquid storage container according to claim 5, wherein in the liquid storage chamber, the moving member pushes and moves the defining member at a position nearer an upper surface than a bottom surface, the bottom surface being surface located at lower side of the liquid storage chamber, the upper surface being surface located at upper side of the liquid storage chamber and opposite to the bottom surface.

9. The liquid storage container according to claim 1, wherein the urging unit is a spring.

10. The liquid storage container according to claim 1, wherein the defining member bends in a direction in which the angle between the wall surface inside the housing member and the defining member in the lower attachment position of the defining member to the housing member increases.

11. The liquid storage container according to claim 10, wherein the thickness of the flexible member varies depending on a position, and the flexible member bends in a position where the thickness of the flexible member changes.

12. The liquid storage container according to claim 11, wherein the flexible member is formed to be thick in the lower attachment position of the defining member to the housing member, and above a bending part in which the flexible member bends, the flexible member is formed to be thin as compared to the thickness in the lower attachment position of the defining member to the housing member.

13. A liquid ejection apparatus mounting a liquid storage container thereon, the liquid storage container comprising:

a housing member having a space therein;

a defining member attached to a wall surface inside the housing member to define the space and including a flexible member having flexibility;

a liquid storage chamber provided in the space defined and capable of storing a liquid therein; and an urging unit configured to urge the defining member in a direction in which a volume of the liquid storage chamber expands, wherein in a position during use, an angle, on the liquid storage chamber side, as between the wall surface inside the housing member and the defining member in a lower attachment position of the defining member to the housing member, is greater than an angle, on the liquid storage chamber side, as between the wall surface inside the housing member and the defining member in an upper attachment position of the defining member to the housing member, and wherein a liquid stored in the liquid storage container can be ejected.

* * * * *